US008469730B2

(12) United States Patent
Garb et al.

(10) Patent No.: US 8,469,730 B2
(45) Date of Patent: Jun. 25, 2013

(54) ELECTRICAL CONNECTOR AND METHOD OF MANUFACTURING SAME

(75) Inventors: Jeffrey W. Garb, West Hills, CA (US); John F. Wadsworth, Burbank, CA (US); Kenneth Mori, Los Angeles, CA (US)

(73) Assignee: Belkin International, Inc., Playa Vista, CA (US)

( * ) Notice: Subject to any disclaimer, the term of this patent is extended or adjusted under 35 U.S.C. 154(b) by 333 days.

(21) Appl. No.: 12/852,401

(22) Filed: Aug. 6, 2010

(65) Prior Publication Data

US 2011/0021040 A1 Jan. 27, 2011

Related U.S. Application Data

(63) Continuation-in-part of application No. 12/537,214, filed on Aug. 6, 2009, now Pat. No. 8,197,260, which is a continuation-in-part of application No. 12/044,897, filed on Mar. 7, 2008, now abandoned, which is a continuation-in-part of application No. PCT/US2009/036301, filed on Mar. 6, 2009, which is a continuation-in-part of application No. 12/044,897, filed on Mar. 7, 2008, now abandoned.

(51) Int. Cl.
*H01R 29/00* (2006.01)

(52) U.S. Cl.
USPC ..... 439/173; 439/107; 439/166; 439/222; 439/956

(58) Field of Classification Search
USPC ..... 439/107, 116, 166, 173, 217, 222, 439/223, 518, 536, 956
See application file for complete search history.

(56) References Cited

U.S. PATENT DOCUMENTS

| | | | |
|---|---|---|---|
| 1,238,448 | A | 8/1917 | Shaw |
| 1,613,647 | A | 1/1927 | Davies et al. |
| 1,699,722 | A | 1/1929 | Stott |
| 1,699,958 | A | 1/1929 | Eby |
| 1,714,763 | A | 5/1929 | Boyson |
| 1,817,004 | A | 8/1931 | Hubbell, Jr. |
| 1,846,251 | A | 2/1932 | Donahue |
| 1,873,042 | A | 8/1932 | Rohrdanz |
| 1,950,036 | A | 3/1934 | Preston |
| 1,975,964 | A | 10/1934 | Mayhew |

(Continued)

FOREIGN PATENT DOCUMENTS

WO WO9966605 A1 12/1999

OTHER PUBLICATIONS

International Search Report for Application No. PCT/US 09/36301, dated Jan. 11, 2010.

(Continued)

*Primary Examiner* — James Harvey
(74) *Attorney, Agent, or Firm* — Bryan Cave LLP

(57) ABSTRACT

An apparatus configured to provide electrical power received from at least a first electrical outlet or a second electrical outlet is disclosed. The apparatus can include: (a) a housing; (b) at least two electrical outlets at the housing; (c) an electrical coupler at least partially enclosed by the housing and electrically coupled to the at least two third electrical outlets; (d) a first prong adapter configured to removably couple to the electrical coupler and the first electrical outlet; and (e) a second prong adapter configured to removably couple to the electrical coupler and the second electrical outlet. Other embodiments are described herein.

25 Claims, 21 Drawing Sheets

U.S. PATENT DOCUMENTS 1,978,805 A 10/1934 McCloy et al.
1,981,458 A 11/1934 McCloy et al.
1,984,181 A 12/1934 French
2,027,447 A 1/1936 Percy
2,226,209 A 12/1940 Rizutto
2,301,258 A 11/1942 Corlew
2,305,100 A 12/1942 O'Brien
2,305,101 A 12/1942 O'Brien
2,326,181 A 8/1943 Sundquist et al.
2,425,679 A 8/1947 Jackson
2,433,938 A 1/1948 Varner
2,447,026 A 8/1948 O'Brien
2,474,070 A 6/1949 Sokolik
2,542,609 A 2/1951 Wyglendowski
2,542,935 A 2/1951 McElroy
2,564,159 A 8/1951 Greacen, Jr.
2,570,784 A 10/1951 Ferguson
2,645,759 A 7/1953 Solari
2,654,869 A 10/1953 Mudd, Jr.
2,855,578 A 10/1958 Hirsch
2,869,102 A 1/1959 Hubbell, Jr.
2,892,172 A 6/1959 McGann, Jr.
2,894,242 A 7/1959 Bickford et al.
2,898,572 A 8/1959 Shinn
3,032,740 A 5/1962 Von Hoorn
3,045,201 A 7/1962 Hall
3,137,536 A 6/1964 Healy
3,335,395 A 8/1967 Smith
3,355,695 A 11/1967 Overesch
3,392,362 A 7/1968 Lipinski
3,474,376 A 10/1969 Preiss
3,479,632 A 11/1969 Galles
3,718,890 A 2/1973 Sheldon
3,747,049 A 7/1973 Cressman et al.
3,760,338 A 9/1973 Bruels
3,860,312 A 1/1975 Gordon, Jr.
3,873,951 A 3/1975 Blake
3,950,069 A 4/1976 Wiley
3,975,075 A 8/1976 Mason
4,026,618 A 5/1977 Straka
D246,241 S 11/1977 Jacobs
4,086,643 A 4/1978 Jacobs
4,307,925 A 12/1981 Drew
D270,628 S 9/1983 Bobrovniczky
4,484,185 A 11/1984 Graves
4,488,201 A 12/1984 Webb et al.
D280,894 S 10/1985 Dickey
4,567,544 A 1/1986 Ronemus et al.
4,643,508 A 2/1987 Schaller
4,679,884 A 7/1987 Klemp
4,743,999 A 5/1988 Hames
4,771,367 A 9/1988 Serr et al.
4,773,866 A 9/1988 Basques
4,857,013 A 8/1989 Peters
4,927,376 A 5/1990 Dickie
5,114,352 A 5/1992 Gahagen et al.
5,249,970 A 10/1993 Jennings
5,399,093 A 3/1995 Schneider et al.
5,466,165 A 11/1995 Boesel et al.
5,595,503 A 1/1997 Pittman et al.
5,660,554 A 8/1997 Mead
5,684,689 A 11/1997 Hahn
5,734,542 A 3/1998 Cohen
5,775,921 A 7/1998 Chou
5,957,701 A 9/1999 McMillin
5,997,310 A 12/1999 Chiu et al.
6,004,138 A 12/1999 Harbetson
6,039,608 A 3/2000 Amero, Jr. et al.
6,089,921 A 7/2000 Chou
6,116,958 A 9/2000 Reichle
6,669,495 B2 12/2003 Philips et al.
6,862,403 B2 3/2005 Pedrotti et al.
6,902,406 B1 6/2005 Kraus
6,923,667 B1 8/2005 Chen
6,942,508 B2 9/2005 Wong
6,984,153 B2 1/2006 Lai et al.
7,063,563 B1 6/2006 Hsu
7,066,767 B2 6/2006 Liao
7,168,968 B1 1/2007 Li
7,168,969 B1 1/2007 Wang
7,220,139 B1 5/2007 Chang et al.
7,273,384 B1 9/2007 So
7,445,513 B1 11/2008 Lee
7,462,074 B1 12/2008 Devlin et al.
2005/0250375 A1 11/2005 Allison
2006/0030168 A1 2/2006 Miura
2007/0278996 A1 12/2007 So
2008/0261430 A1 10/2008 Wadsworth
2011/0021040 A1* 1/2011 Garb et al. ..... 439/13
2011/0187552 A1* 8/2011 Garb ..... 340/815.45

OTHER PUBLICATIONS

International Search Report and Written Opinion from PCT/US2010/044791, 12 pages. Oct. 6, 2010.

Griffin Technology: PowerBlock travel; international charger; http://www.griffintechnology.com/products/powerblocktravel; Feb. 15, 2008; 3 pages.

Cyberguys.com; 360 Rotating Single Outlet Surge, Grounged; http://www.cyberguys.com/templates/SearchDetail.asp-?productID=13122; Feb. 15, 2008; 2 pages.

Belkin 6-Socket SurgeMaster@Superior Series with Telephone Protection; http://catalog.belkin.com/IWCatProductPage.process?Product_Id=135152; Mar. 7, 2008; 2 pages.

Belkin: Travel Surge Protector with Hidden Swivel Plug; http://catalog.belkin.com/IWCatProductPage.process? Product_Id=182400; retrieved from the internet on Jan. 29, 2008.

Powergaurd model No. PGNP3452; http://www.rkcable.com.au/PowergaurdPGNP3452.htm; retrieved from the internet on Jan. 29, 2008.

* cited by examiner

FIG. 13
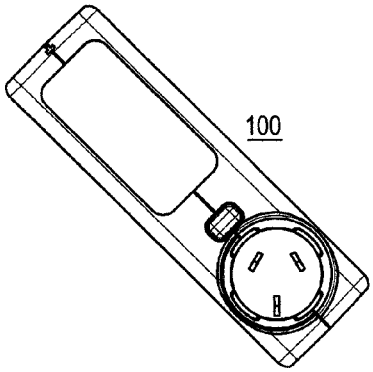
FIG. 9
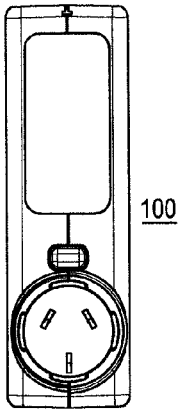
FIG. 12
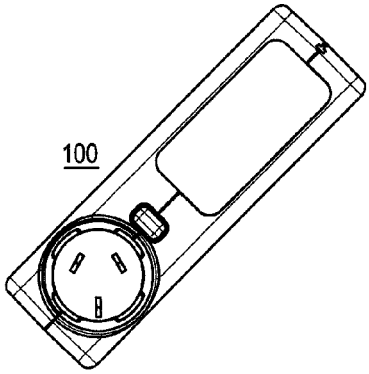
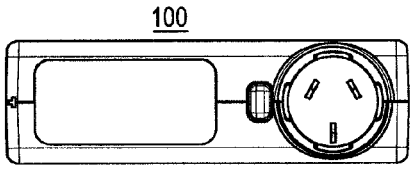
FIG. 10
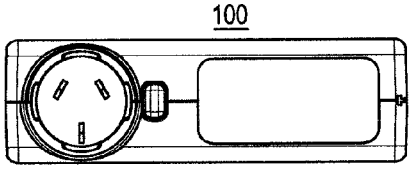
FIG. 8
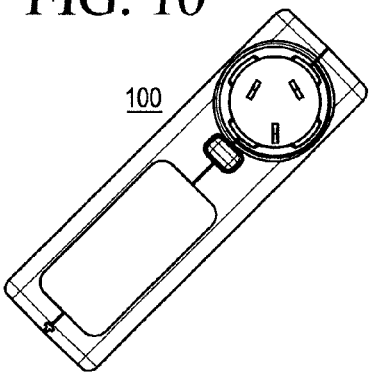
FIG. 14
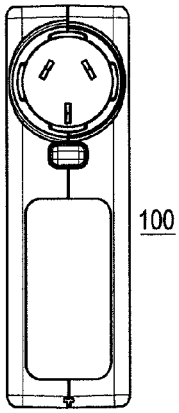
FIG. 11
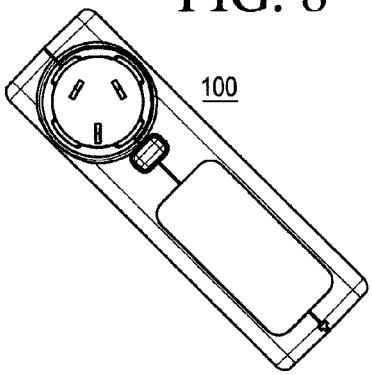
FIG. 15

3800

4100

ELECTRICAL CONNECTOR AND METHOD OF MANUFACTURING SAME

CLAIM OF PRIORITY

This application is a continuation-in-part non-provisional patent application claiming priority to U.S. patent application Ser. No. 12/537,214, filed on Aug. 6, 2009, titled Electrical Connector and Method of Manufacturing Same, which is a continuation-in-part non-provisional patent application claiming priority to U.S. patent application Ser. No. 12/044,897, filed on Mar. 7, 2008, titled Electrical Connector and Method of Manufacturing Same. This application is also a continuation-in-part non-provisional patent application claiming priority to PCT Application No. PCT/US09/36301, filed on Mar. 6, 2009, titled Electrical Connector and Method of Manufacturing Same, which is a continuation-in-part non-provisional patent application claiming priority to U.S. patent application Ser. No. 12/044,897, filed on Mar. 7, 2008, titled Electrical Connector and Method of Manufacturing Same.

TECHNICAL FIELD

This invention relates generally to electrical connectors, and relates more particularly to rotatable electrical connectors and/or power strips or surge protectors useable in multiple countries.

BACKGROUND

Electrical connectors, such as surge protectors, can be used to couple electrical products to power sources. Many electrical connectors, however, are undesirable in some circumstances, including travel applications, when it comes to providing flexibility and functionality for coupling electrical products to power sources. Also, most electrical connectors designed for travel applications are ungrounded, and thus are incompatible for electrical products with polarized electrical prongs, or plugs incorporating a ground prong. Other electrical connectors are too unwieldy for travel applications because they comprise bulky power cords or are fixed in one orientation defined by the alignment of their power prongs relative to prong sockets on the power source. This configuration in turn forces electrical products and/or their power plugs to couple to the electrical connector at one specific orientation, which may not be suitable for the particular electric product, or the particular location where the power source is situated. In addition, most electrical connectors are limited to couple with only one type of power source outlet, and thus cannot couple to power sources in countries with different electrical standards and/or different power source outlets.

Accordingly, a need exists for a compact electrical connector that addresses these problems by providing more flexibility for coupling to different power sources, and more alignment options for coupling electrical products.

BRIEF DESCRIPTION OF THE DRAWINGS

The invention will be better understood from a reading of the following detailed description of examples of embodiments, taken in conjunction with the accompanying figures in the drawings in which:

FIG. 8 illustrates a front view of the electrical connector of FIG. 1 at a first predetermined orientation.

FIG. 9 illustrates a front view of the electrical connector of FIG. 1 at a second predetermined orientation.

FIG. 10 illustrates a front view of the electrical connector of FIG. 1 at a third predetermined orientation.

FIG. 11 illustrates a front view of the electrical connector of FIG. 1 at a fourth predetermined orientation.

FIG. 12 illustrates a front view of the electrical connector of FIG. 1 at a fifth predetermined orientation.

FIG. 13 illustrates a front view of the electrical connector of FIG. 1 at a sixth predetermined orientation.

FIG. 14 illustrates a front view of the electrical connector of FIG. 1 at a seventh predetermined orientation.

FIG. 15 illustrates a front view of the electrical connector of FIG. 1 at an eighth predetermined orientation.

Figure 1:
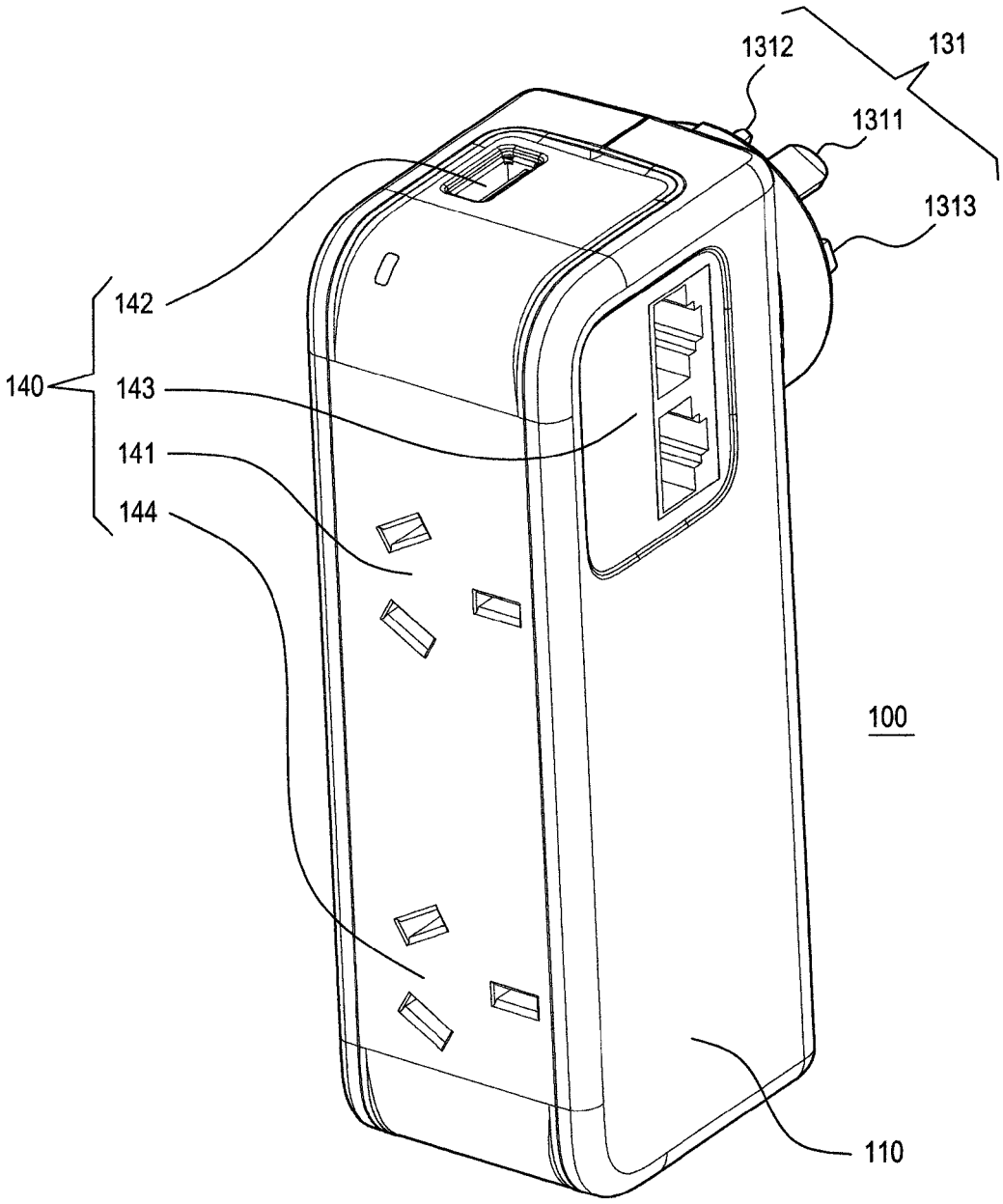
FIG. 1 illustrates a top, side, rear isometric view of an electrical connector, showing a prong adapter coupled to the electrical connector's housing via a rotation coupler, according to a first embodiment.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of examples of embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, physically, mechanical, or other manner. The term "ring," as used herein, includes items with a general annular, elliptical, polygonal, circular, and/or oval shape.

DETAILED DESCRIPTION

Some embodiments can concern an apparatus configured to provide electrical power received from at least a first electrical outlet and a second electrical outlet. The first electrical outlet configured to provide first electrical power with a first voltage. The second electrical outlet configured to provide second electrical power with a second voltage different than the first voltage. The apparatus can include: (a) a housing; (b) at least two third electrical outlets at the housing; (c) an electrical coupler at least partially enclosed by the housing and electrically coupled to the at least two third electrical outlets; (d) a first prong adapter configured to removably couple to the electrical coupler and the first electrical outlet; (e) a second prong adapter configured to removably couple to the electrical coupler and the second electrical outlet. The first prong adapter can be configured to receive the first electrical power with the first voltage from the first electrical outlet when the first prong adapter is coupled to the first electrical outlet. The second prong adapter can be configured to receive the second electrical power with the second voltage from the second electrical outlet when the second prong adapter is coupled to the second electrical outlet. The electrical coupler can be electrically coupled to the at least two third electrical outlets such that when the first prong adapter is coupled to the electrical coupler and the first electrical outlet, the at least two third electrical outlets receive the first electrical power with the first voltage. The electrical coupler can be further electrically coupled to the at least two third electrical outlets such that when the second prong adapter is coupled to the electrical coupler and the second electrical outlet, the at least two third electrical outlets receive the second electrical power with the second voltage.

In other embodiments, an electrical power adapter can include: (a) a housing with an interior cavity; (b) two or more electrical outlets accessible through the housing; (c) a first surge protection module at least partially located in the interior cavity of the housing and electrically coupled to the two or more electrical outlets; (d) an electrical attachment mechanism at the housing and electrically coupled to the surge protection module; and (e) two or more prong devices configured to removably couple to the electrical attachment mechanism. At least a first one of the two or more prong devices can include at least part of a second surge protection module. Each of the two or more prongs devices can include an electrical plug. Each of the electrical plugs of the two or more prong devices are configured to couple to a different country-style electrical outlet.

Still further embodiments can concern a method of providing an electrical device configured to couple to a first electrical outlet and a second electrical outlet. The first electrical outlet can be configured to provide first electrical power with a first voltage. The second electrical outlet can be configured to provide second electrical power with a second voltage, The method can include: providing a first prong adapter configured to removably couple to the first electrical outlet; providing a second prong adapter configured to removably couple to the second electrical outlet; providing at least two third electrical outlets; providing a electrical coupler configured to removably coupled to the first prong adapter and the second prong adapter; and electrically coupling the electrical coupler to the at least two third electrical outlets such that when the first prong adapter is coupled to the electrical coupler and the first electrical outlet, the at least two third electrical outlets receive the first electrical power with the first voltage and that when the second prong adapter is coupled to the electrical coupler and the second electrical outlet, the at least two third electrical outlets receive the second electrical power with the second voltage.

In one embodiment, an electrical connector comprises a housing, at least two electrical outlets accessible through the housing, a rotation coupler at least partially enclosed by the housing and coupled to the at least two electrical outlets, and a prong adapter coupled to the rotation coupler. The rotation coupler comprises a line contact, a neutral contact, and a ground contact. The prong adapter comprises a prong set with at least two of a line prong configured to couple with the line contact, a neutral prong configured to couple with the neutral contact, and a ground prong configured to couple with the ground contact. The rotation coupler is configured to allow a rotational movement of the housing relative to the prong adapter.

In a second embodiment, an apparatus for providing electrical power comprises a housing, at least two electrical outlets at the housing, a rotation coupler at least partially enclosed by the housing and coupled to the at least two electrical outlets, and a prong adapter rotatable relative to the rotation coupler when secured to the rotation coupler. The rotation coupler comprises: a first contact set comprising a first one of a line contact, a neutral contact, or a ground contact; a second contact set comprising a second one of the line contact, the neutral contact, or the ground contact; and a central contact comprising a third one of the line contact, the neutral contact, or the ground contact. The prong adapter comprises a prong set comprising a first prong configured to couple with the first contact set of the rotation coupler and comprising a first one of a line prong, a neutral prong, or a ground prong; a second prong configured to couple with the second contact set of the rotation coupler and comprising a second one of the line prong, the neutral prong, or the ground prong; and a third prong configured to couple with the central contact of the rotation coupler and comprising a third one of the line prong, the neutral prong, or the ground prong. The first contact set comprises two or more first contact flanges configured to couple with the first prong at a rear of the prong adapter, and the second contact set comprises two or more second contact flanges configured to couple with the second prong at the rear of the prong adapter.

Figure 2:
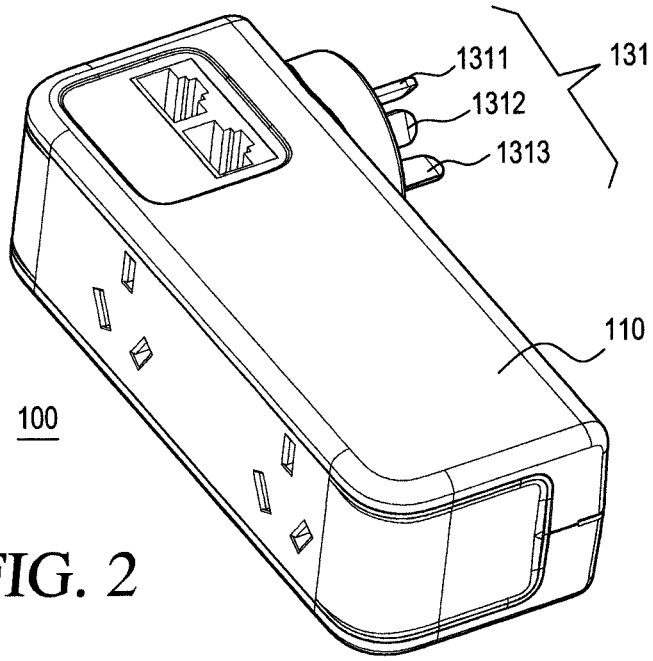
FIG. 2 illustrates a bottom, side, rear isometric view of the electrical connector from FIG. 1.
Figure 3:
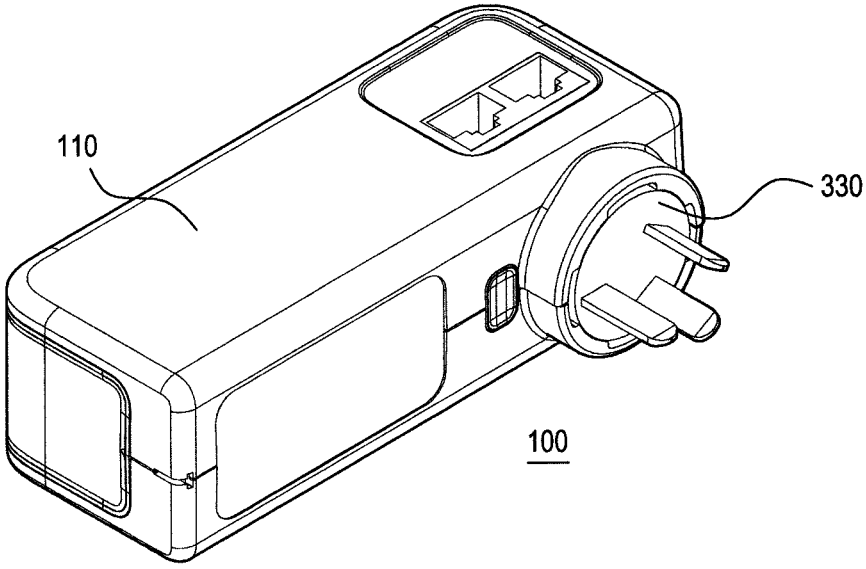
FIG. 3 illustrates a bottom, side, front isometric view the electrical connector from FIG. 1
Figure 4:
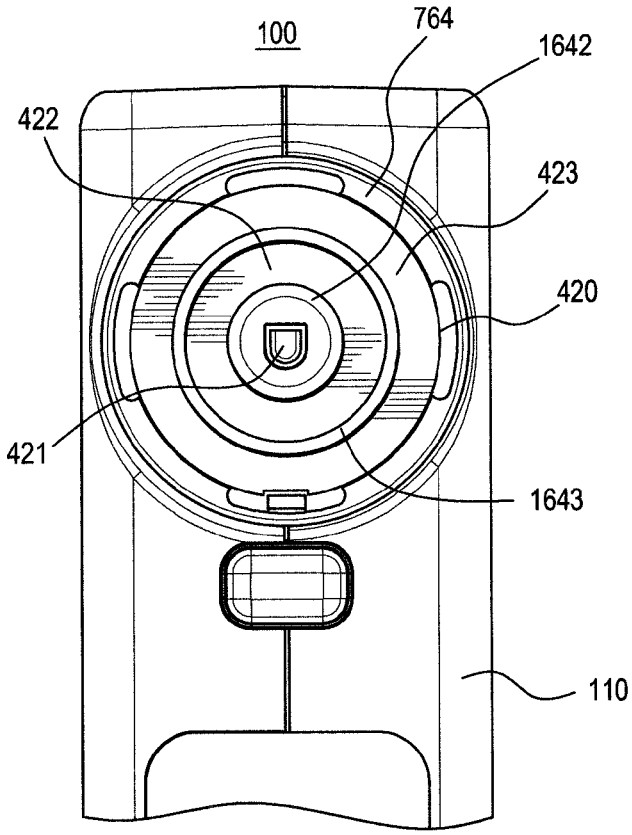
FIG. 4 illustrates a front view of a portion of the electrical connector from FIG. 1, showing the prong adapter decoupled form the rotation coupler.
Figure 5:
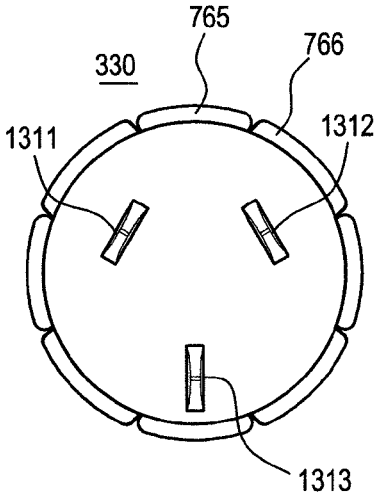
FIG. 5 illustrates a front view of the prong adapter from FIGS. 1-3.
Figure 6:
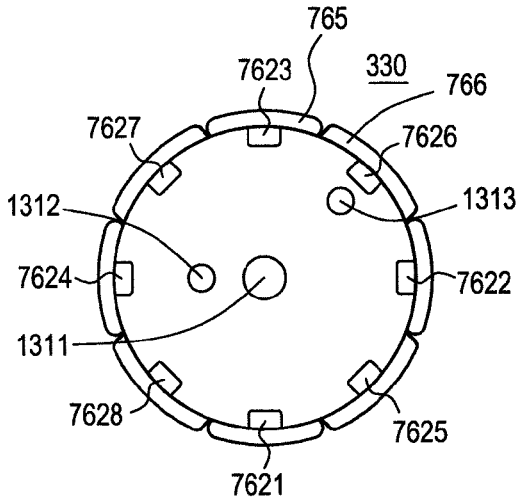
FIG. 6 illustrates a rear view of the prong adapter from FIGS. 1-3.
Figure 7:
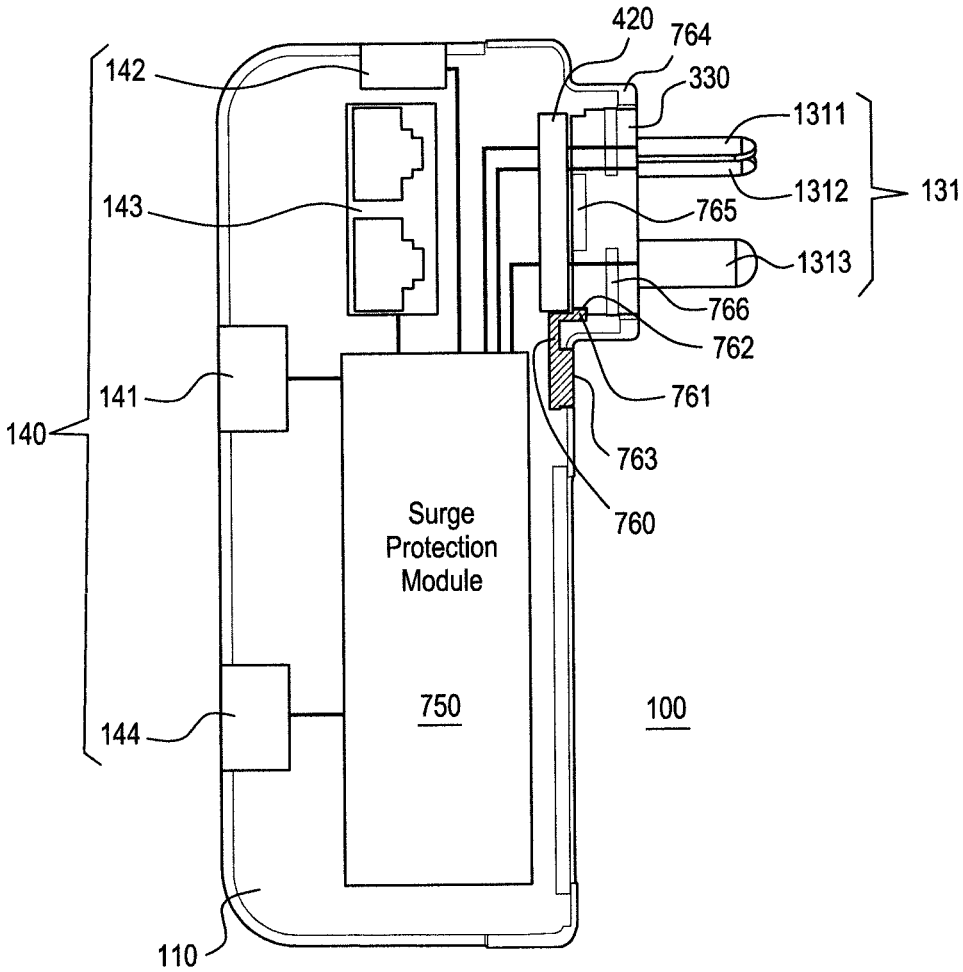
FIG. 7 illustrates a cross sectional view of the electrical connector of FIG. 1, showing a locking mechanism, and internal connections of different elements.

Turning to the drawings, FIG. 1 illustrates a top, side, rear isometric view of electrical connector 100, according to a first embodiment. FIG. 2 illustrates a bottom, side, rear isometric view of electrical connector 100. FIG. 3 illustrates a bottom, side, front isometric view of electrical connector 100. FIG. 4 illustrates a front view of a portion of electrical connector 100, with prong adapter 330 decoupled from rotation coupler 120. FIG. 5 illustrates a front view of prong adapter 330. FIG. 6 illustrates a rear view of prong adapter 330. FIG. 7 illustrates a cross sectional view of electrical connector 100, showing internal connections of different elements. FIG. 8 illustrates a front view of electrical connector 100 at a first predetermined orientation of housing 110 relative to prong adapter 330. FIG. 9 illustrates a front view of electrical connector 100 at a second predetermined orientation. FIG. 10 illustrates a front view of electrical connector 100 at a third predetermined orientation. FIG. 11 illustrates a front view of electrical connector 100 at a fourth predetermined orientation. FIG. 12 illustrates a front view of electrical connector 100 at a fifth predetermined orientation. FIG. 13 illustrates a front view of electrical connector 100 at a sixth predetermined orientation. FIG. 14 illustrates a front view of electrical connector 100 at a seventh predetermined orientation. FIG. 15 illustrates a front view of electrical connector 100 at an eighth predetermined orientation.

Electrical connector 100 is merely exemplary and is not limited to the embodiments presented herein. Electrical connector 100 can be employed in many different embodiments or examples not specifically depicted or described herein.

In the example shown in FIGS. 1-15, electrical connector 100 comprises a housing 110, with rotation coupler 420 (FIG. 4) at least partially enclosed by housing 110, and with electrical outlets 140 accessible through the exterior of housing 110. Electrical connector 100 further comprises prong adapter 330 (FIG. 3), with prong set 131, coupled to housing 110 via rotation coupler 420. Electrical connector 100 can comprise, for example, a power strip or power bar.

In one embodiment, housing 110 can have dimensions of approximately 130×50×41 millimeters (mm). In the same or a different embodiment, housing 110 can comprise a neck with a diameter of approximately 38.5 mm protruding from housing 110 a distance of approximately 9 mm. In a different embodiment, any of the listed dimensions of housing 110 can be increased or decreased by up to 30 mm.

In the present embodiment, electrical outlets 140 comprise AC outlet 141, USB outlet 142, Ethernet outlet 143, and AC outlet 144. In a different embodiment, electrical connector 100 can comprise other combinations of electrical outlets 140, including different types of electrical outlets 140 not specifically shown in the example of FIGS. 1-15 such as telephone jacks.

In the example of FIGS. 1-15, one or more of electrical outlets 140 are electrically coupled to prong set 131 via the interior of housing 110 (FIG. 7). Electrical connector 100 can thus be used to provide an electrical connection from an electrical source (not shown) coupled to prong set 131 to one or more electrical devices (not shown) coupled to one or more of electrical outlets 140. In one example, the electrical source can be an AC wall outlet to which prong set 131 of prong adapter 330 couples. In a different example, the electrical source can be an extension cord or another power bar or strip comprising outlets to which prong set 131 can also couple.

In the same or a different example, electrical connector 100 can comprise surge protection module 750 (FIG. 7) contained within housing 110 and coupled to electrical outlets 140 to protect any electrical devices coupled to electrical outlets 140 from voltage spikes or other power conditioning inconsistencies of the electrical source by, for example, blocking or shorting to ground voltages above a safe threshold.

Surge protection module 750 can be electrically coupled between rotation coupler 420 and electrical outlets 140 (FIG. 7). In such an example, when prong adapter 330 couples to rotation coupler 120, the surge protection module lies along the electrical path between prong set 131 and electrical outlets 140 to restrict power conditioning inconsistencies from reaching or affecting the electrical devices coupled to electrical outlets 140. In a different example, surge protection module 750 may not be provided, and the electrical path between electrical outlets 140 and prong set 131 would be more direct while foregoing protection against power conditioning inconsistencies.

As illustrated in FIGS. 4-6, the rotation coupler 420 of electrical connector 100 comprises contact 421, contact 422, and contact 423, while prong adapter 330 comprises at least two of prong 1311, prong 1312, and prong 1313. Parts of prongs 1311-1313 that protrude and/or are accessible through the rear of prong adapter 330 configured to contact rotation coupler 420 can be referred to as couplers. Electrical connector 100 is configured such that, when prong adapter 330 is coupled to rotation coupler 420, contact 421 couples to prong 1311, and contact 422 couples to prong 1312. In addition, for cases where prong adapter 330 comprises prong 1313, contact 423 couples to prong 1313 when prong adapter 330 is coupled to rotation coupler 420. In this embodiment, prong 1313 can be a ground prong.

Different prongs may be assigned different characteristics in different embodiments. However, as will be seen from the following examples, the coupling relationship between one type of prong and the corresponding type of contact remains constant.

In one example, prong 1311 and contact 421 comprise a line prong and a line contact, respectively, and prong 1312 and contact 422 comprise a neutral prong and a neutral contact, respectively, while prong 1313 and contact 423 comprise a ground prong and a ground contact, respectively.

In a different example, prong 1311 and contact 421 comprise a line prong and a line contact, respectively, and prong 1312 and contact 422 comprise a ground prong and a ground contact, respectively, while prong 1313 and contact 423 comprise a neutral prong and a neutral contact, respectively.

In an alternate example, prong 1311 and contact 421 comprise a neutral prong and a neutral contact, respectively, and prong 1312 and contact 422 comprise a line prong and a line contact, respectively, while prong 1313 and contact 423 comprise a ground prong and a ground contact, respectively.

In another different example, prong 1311 and contact 421 comprise a neutral prong and a neutral contact, respectively, and prong 1312 and contact 422 comprise a ground prong and a line contact, respectively, while prong 1313 and contact 423 comprise a line prong and a line contact, respectively.

In another alternate example, prong 1311 and contact 421 comprise a ground prong and a ground contact, respectively, and prong 1312 and contact 422 comprise a line prong and a line contact, respectively, while prong 1313 and contact 423 comprise a neutral prong and a neutral contact, respectively.

In yet another different example, prong 1311 and contact 421 comprise a ground prong and a ground contact, respectively, and prong 1312 and contact 422 comprise a neutral prong and a neutral contact, respectively, while prong 1313 and contact 423 comprise a line prong and a line contact, respectively.

In yet another alternate example, other combinations can be possible, including examples where prong adapter 330 comprises only two of prong 1311, prong 1312, and prong 1313.

In many embodiments, however, the line prong is configured to couple to the line contact, the neutral prong is configured to couple to the neutral contact, and the ground prong is configured to couple to the ground contact, when rotation coupler 420 is coupled to prong adapter 330. In one embodiment, this configuration can be achieved by placing the line contact a first distance away from a center of rotation coupler 420, the neutral contact a second distance away from the center of rotation coupler 420, and the ground contact a third distance away from the center of rotation coupler 420 (FIG. 4), while locating a line coupler of the line prong a first distance away from a center of prong adapter 330, a neutral coupler of the neutral prong a second distance away from the center of prong adapter 330, and a ground coupler of the ground prong a third distance away from the center of prong adapter 330 (FIG. 6), wherein the first, second, and third distance from the center of rotation coupler 420 are substantially equal, respectively, to the first, second and third distance from the center of prong adapter 330.

As illustrated in FIGS. 8-15, rotation coupler 420 is configured to allow a rotational movement of housing 110 relative to prong adapter 330. In the present embodiment of FIGS. 1-15, the rotational movement of housing 110 comprises 360 degrees relative to prong adapter 330. In a different example, the rotational movement of housing 110 could be limited to a subset of 360 degrees relative to prong adapter 330.

In the present embodiment, as illustrated in FIGS. 6 and 7, rotation coupler 420 comprises a portion of a locking mechanism 760. The portion of locking mechanism 760 comprises a lock 761 coupled to rotation coupler 420 (FIG. 7). In addition, prong adapter 330 comprises a second portion of locking mechanism 760 with two or more lock receivers 762 complementary to lock 761 (FIG. 6-7). In the present example, the two or more lock receivers 762 comprise eight lock receivers 7621-7628 spaced around prong adapter 330 in increments comprising multiples of 45 degrees of rotation. In a different example, the two or more lock receivers 762 could be spaced around prong adapter 330 at other multiples of 45 degrees of rotation, such as every 90 degrees, or at other non-45-degree multiples.

The locations of the two or more lock receivers 762 (FIG. 6) of the prong adapter 330 define two or more predetermined orientations along the rotational movement of housing 110 relative to prong adapter 330 (FIGS. 8-15). In the present example, locking mechanism 760 is configured to restrict the rotational movement of the housing 110 relative to prong adapter 330 at eight predetermined orientations, separated from each other by one or more multiples of 45 degrees of rotation, (FIGS. 8-15) when lock 761 couples to a respective one of the two or more lock receivers 762 of prong adapter 330 (FIG. 7). In addition, locking mechanism 760 is configured to permit the rotational movement of housing 110 relative to prong adapter 330 when lock 761 is not coupled to any of the two or more lock receivers 762.

In the present embodiment, as shown in FIG. 7, locking mechanism 760 comprises a lock de-actuator 763 coupled to lock 761 and protruding through an exterior of housing 110. Lock de-actuator 763 can be operated by pressing it against housing 110, causing lock 761 to decouple from any of the two or more lock receivers 762 of prong adapter 330 to allow the rotational movement of housing 110 relative to prong adapter 330.

Figure 16:
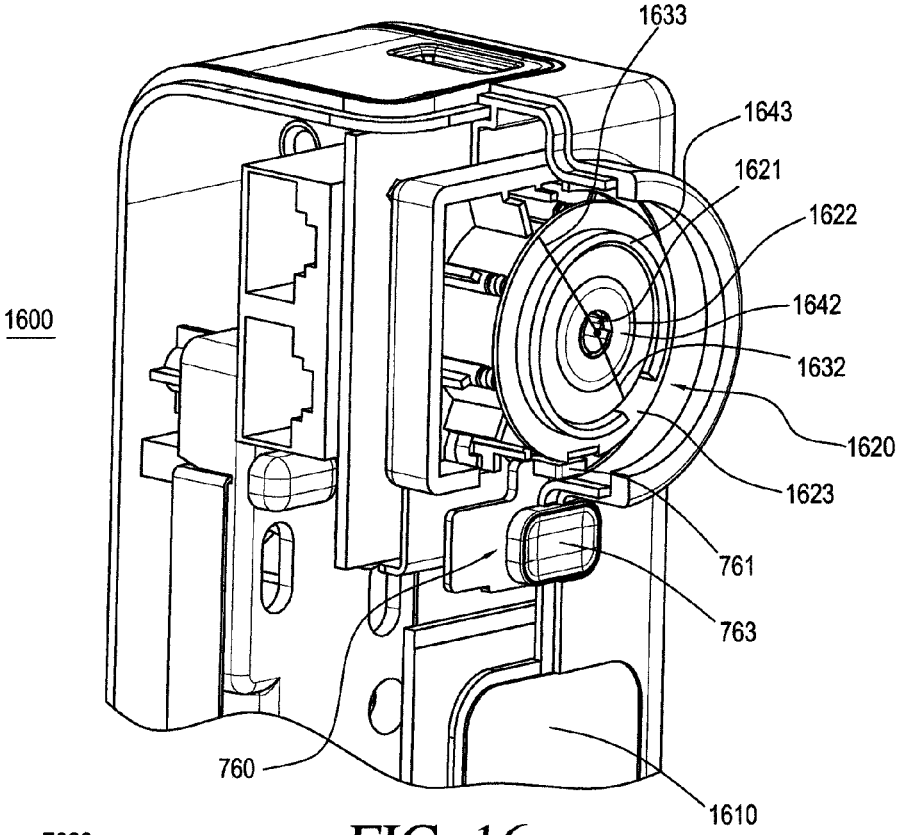
FIG. 16 illustrates a cross sectional, isometric view of a portion of an electrical connector, which is a similar embodiment of the electrical connector of FIGS. 1-15, without a prong adapter.
Figure 17:
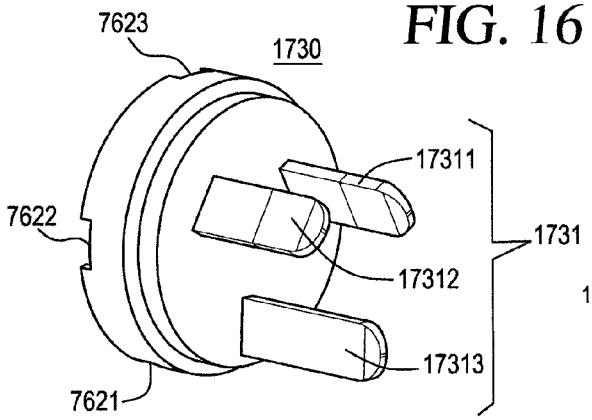
FIG. 17 illustrates an isometric front view of a prong adapter of the electrical connector of FIG. 16.
Figure 18:
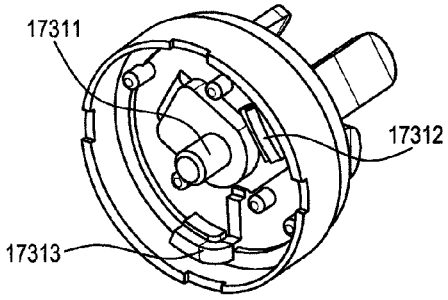
FIG. 18 illustrates an isometric rear view of the prong adapter of FIG. 17.

Continuing with the figures, FIG. 16 illustrates a cross sectional, isometric view of a portion of electrical connector 1600, which is a similar embodiment of electrical connector 100 of FIGS. 1-15. FIG. 17 illustrates an isometric front view of a prong adapter 1630. FIG. 18 illustrates an isometric rear view of prong adapter 1630.

As illustrated in FIG. 16, electrical connector 1600 comprises a rotation coupler 1620 comprising prong contact 1621, prong contact 1622, and prong contact 1623 similar to contact 421, contact 422, and contact 423 of rotation coupler 420 (FIG. 4), respectively, for electrical connector 100.

Rotation coupler 1620 is configured with concentric rail contacts such as contacts 1622 and 1623. In the present embodiment, the different prong contacts comprise full rings of different perimeters, with contact 1622 defined by a ring of radius 1632, and contact 1623 defined by a ring of radius 1633. In a different embodiment, the different prong contacts may comprise only part of a full ring. In either case, an outer perimeter of contact 1621 is located within, and electrically isolated from, an inner perimeter of contact 1622. Similarly, an outer perimeter of prong contact 1622 is located within, and electrically isolated from, an inner perimeter of prong contact 1623. In the present embodiment, contacts 1621 and 1622 are electrically isolated from each other by isolation barrier 1642, while contacts 1622 and 1623 are electrically isolated from each other by isolation barrier 1643, where isolation barriers 1642 and 1643 comprise rings of nonconductive material. The rings can be continuous or discontinuous.

As illustrated in FIGS. 17-18, rotation coupler 1620 couples to prong adapter 1730, similar to prong adapter 330 of electrical connector 100 (FIGS. 5-6). Prong adapter 1730 comprises a prong set 1731, having at least two of prong 17311, prong 17312, and prong 17313. In the present example, all three prongs are present in prong set 1731.

As can be seen in FIG. 18, the different prongs of prong set 1731 protrude through the rear of prong adapter 1730. In the same or a different example, the different prongs do not protrude through the rear of prong adapter 1730 at a point directly opposite to the respective prong at the front of prong adapter 1730 (FIG. 17). Instead, they are routed internally through prong adapter 1730 to protrude at a point aligned with the perimeter of their respective prong contact at rotation coupler 120. In the present example, prong 17311 protrudes through the center of the rear of prong adapter 1730, lining up with prong contact 1621 (FIG. 16) at the center of rotation coupler 1620. Similarly, prong 17312 protrudes through the rear of prong adapter 1730 at a point separated from the center of prong adapter 1730 by radius 1632, the same radius that defines prong contact 1622 (FIG. 16). Likewise, prong 17313 protrudes through the rear of prong adapter 1730 at a point separated from the center of prong adapter 1730 by radius 1633, the same radius that defines prong contact 1623 (FIG. 16).

Because of the radial alignments described above, when prong adapter 1730 (FIGS. 17-18) is coupled to rotation coupler 1620 (FIG. 16), prong contact 1621 couples with prong 17311, and prong contact 1622 couples with prong 17312. In addition, while housing 1610 is rotated relative to prong adapter 1730, prong contact 1621 remains coupled to prong 17311, and prong contact 1622 remains coupled to prong 17312.

In the present and other embodiments where prong adapter 1730 comprises each of prong 17311, prong 17312, and prong 17313, prong contact 1623 couples with prong 17313 when prong adapter 1730 is coupled to rotation coupler 1620. In addition, while housing 1610 is rotated relative to prong adapter 1730, prong contact 1623 remains coupled to prong 17313.

Although electric connector 1600 is shown in an exploded view in FIGS. 16-18, with prong adapter 1730 separated from rotation coupler 1620, electric connector 1600 can be configured such that prong adapter 1730 is not removable from rotation coupler 1620, while still retaining the capability of allowing rotational movement.

Figure 23:
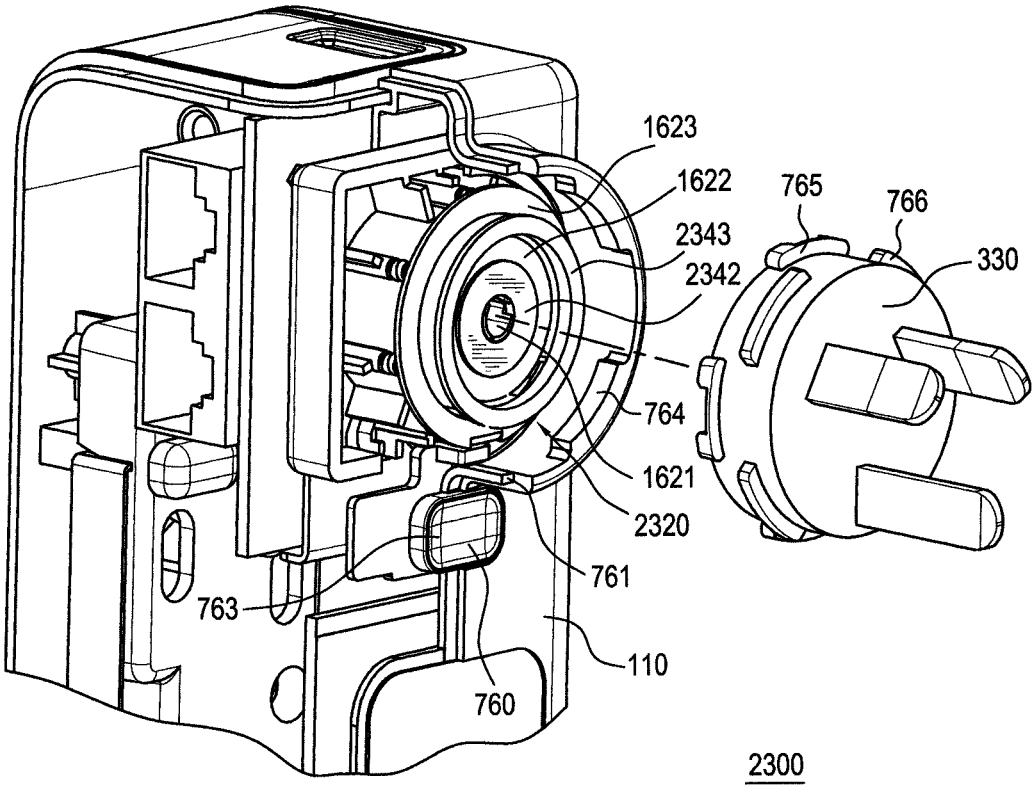
FIG. 23 illustrates a cross sectional, isometric view of a portion of an electrical connector, which is a similar embodiment of the electrical connector of FIG. 16.

Skipping ahead with the figures, FIG. 23 illustrates a rotation coupler 2320, which is a related embodiment of rotation coupler 1620 from FIG. 16. Rotation coupler 2320 differs from rotation coupler 1620 by further comprising retainer ring 2342 coupled to a top of isolation barrier 1642 (FIG. 16), and retainer ring 2343 coupled to a top of the isolation barrier 1643 (FIG. 16). Retainer rings 2342 and 2343 keep the contacts 1621-1623 in place when prong adapter 330 is removed from rotation coupler 2320. Under such circumstances, retainer ring 2342 couples with and retains the outer perimeter of prong contact 1621 and the inner perimeter of prong contact 1622, while retainer ring 2343 couples with and retains the outer perimeter of prong contact 1622 and the inner perimeter of prong contact 1623.

Figure 19:
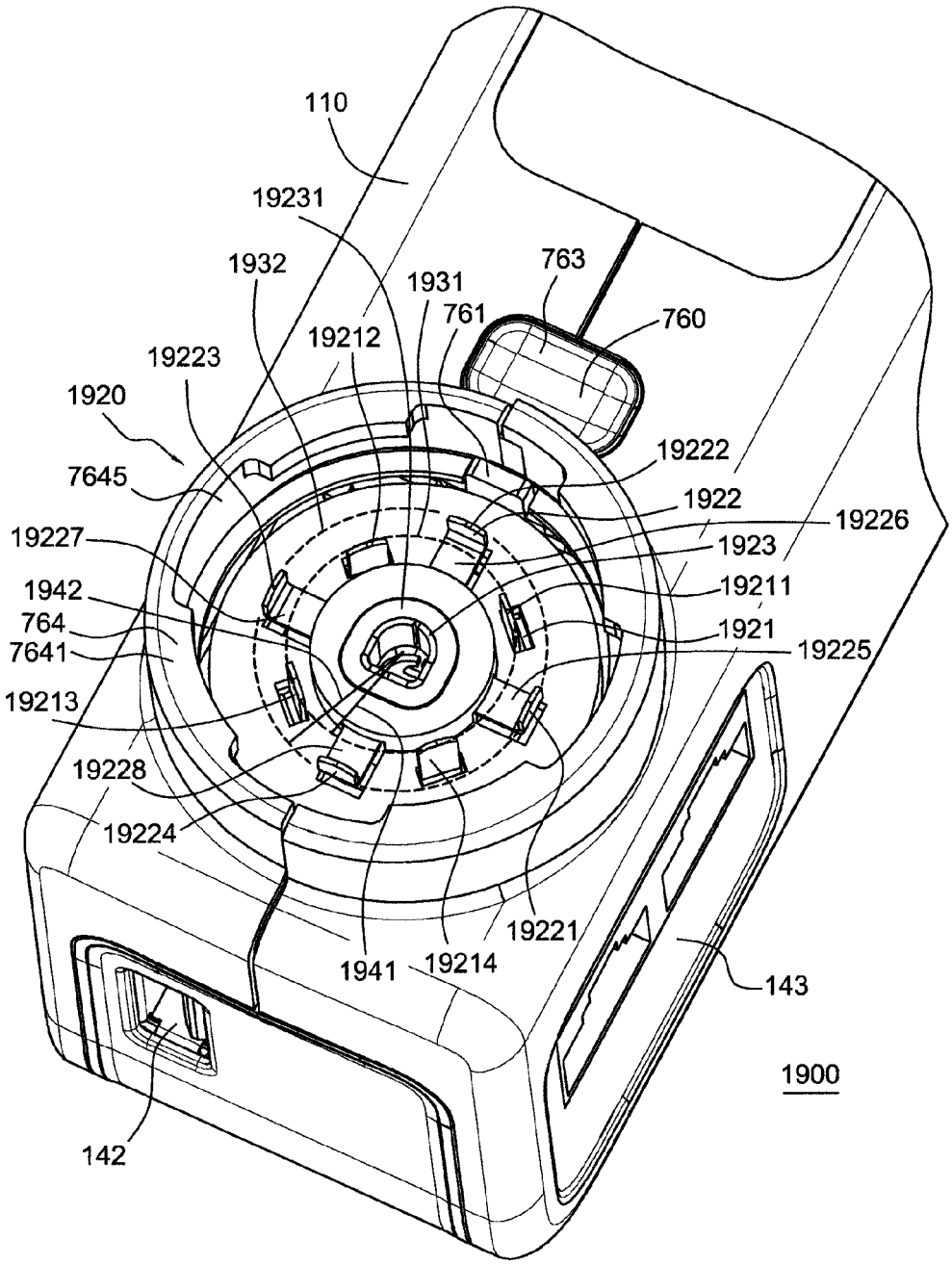
FIG. 19 illustrates an isometric view of a portion of an electrical connector, which is a similar embodiment of the electrical connector of FIGS. 1-15 and the electrical connector of FIGS. 16-18, without a prong adapter.
Figure 20:
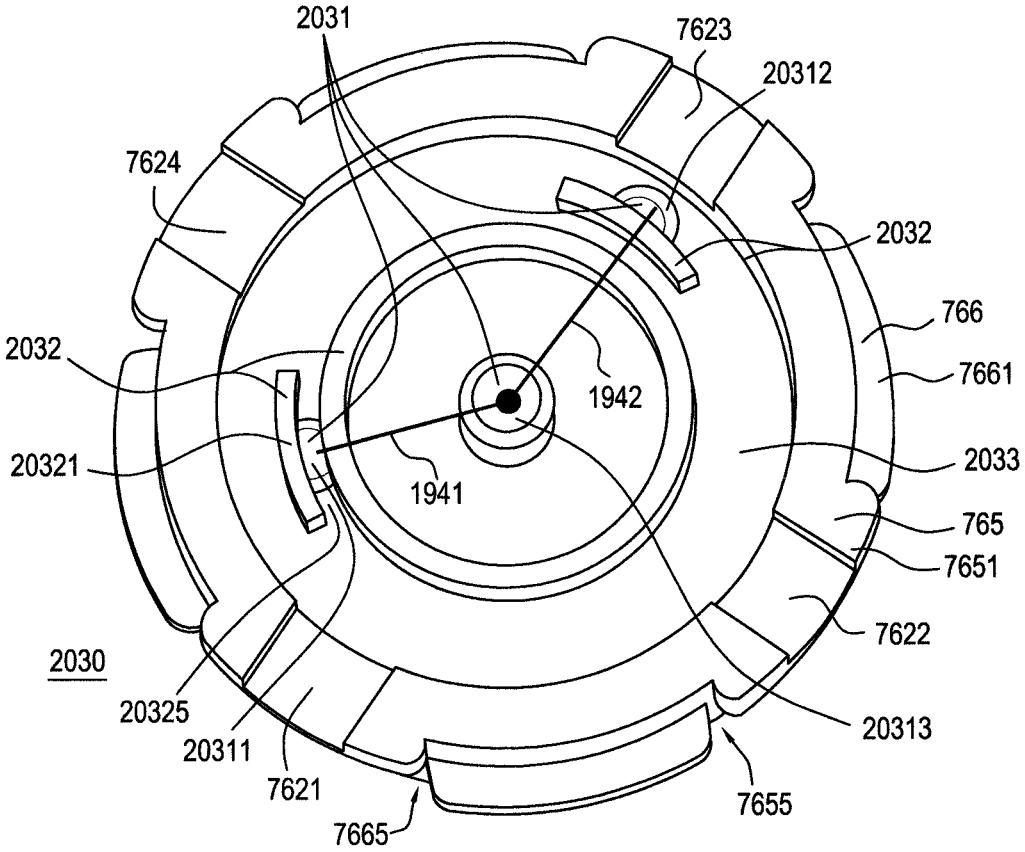
FIG. 20 illustrates a rear view of a prong adapter of the electrical connector of FIG. 19.
Figure 21:
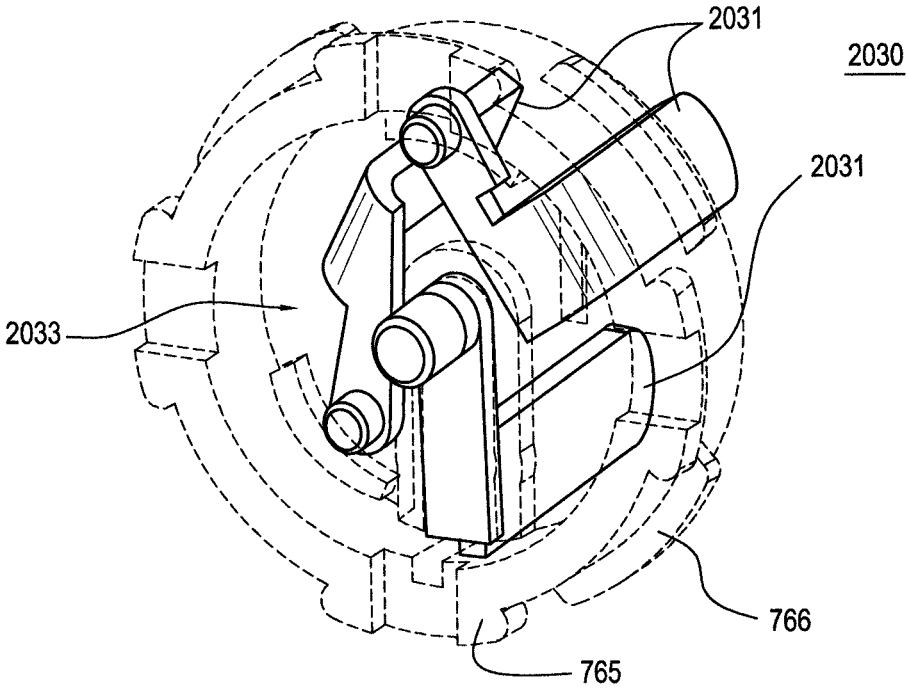
FIG. 21 illustrates a translucent rear view of the prong adapter of FIG. 20.
Figure 22:
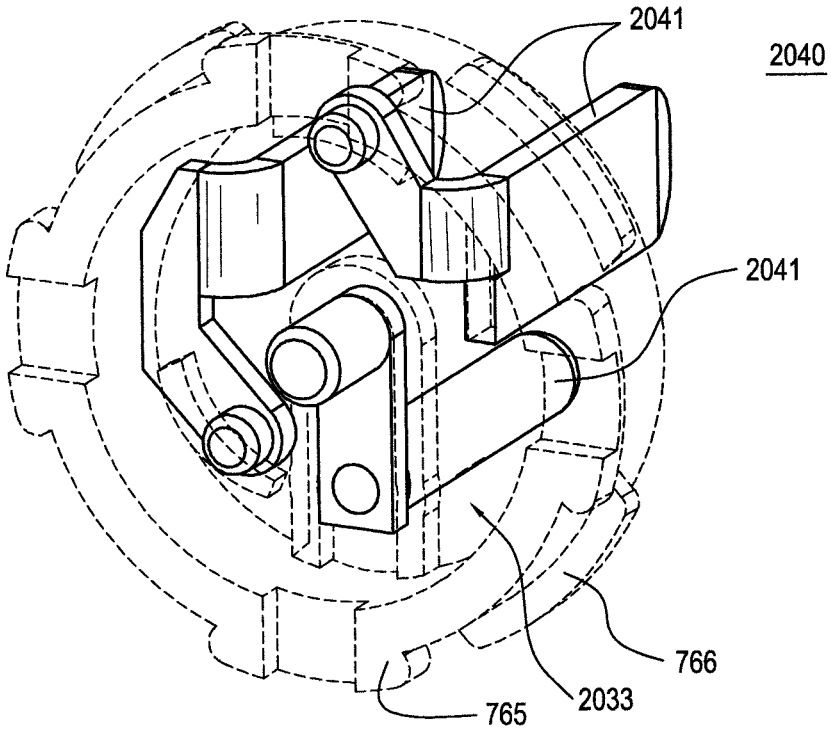
FIG. 22 illustrates a translucent rear view of a prong adapter interchangeable with the prong adapter of FIG. 20-21.

Backtracking through the figures, FIG. 19 illustrates an isometric view of a portion of electrical connector 1900, which is a similar embodiment of electrical connector 100 of FIGS. 1-15 and electrical connector 1600 of FIGS. 16-18. FIG. 20 illustrates a rear view of prong adapter 2030, which is a similar embodiment of prong adapter 330 of FIGS. 1-15, and of prong adapter 1730 of FIGS. 17-18. FIG. 21 illustrates a translucent rear view of prong adapter 2030. FIG. 22 illustrates a translucent rear view of prong adapter 2040, which is interchangeable with prong adapter 2030 in the present example.

As illustrated in FIG. 19, electrical connector 1900 comprises a rotation coupler 1920 similar to rotation coupler 420 (FIG. 4) of electrical connector 100. Like rotation coupler 420 (FIG. 4), rotation coupler 1920 is at least partially enclosed by housing 110 and coupled to electrical outlets 140 (FIG. 1).

Rotation coupler 1920 comprises a central contact 1923, contact set 1921 with two or more contact flanges along perimeter 1931 defined by radius 1941 from central contact 1923, and a contact set 1922 with two or more second contact flanges along perimeter 1932 defined by radius 1942 from central contact 1923. In some examples, contact set 1921 and/or contact set 1922 could be referred to as a flange set. There can also be examples where the contact flanges of rotation coupler 1920 could be referred to as contact points. In the present example, the two or more first contact points of contact set 1921 are evenly separated along perimeter 1931, while the two or more second contact points of contact set 1922 are evenly separated along perimeter 1932.

Central contact 1923 can comprise one of a line contact, a neutral contact, or a ground contact, similar to as described for electrical connector 100 above. In turn, contact set 1921 can comprise a different one of the line contact, the neutral contact, or the ground contact. Finally, contact set 1922 can comprise another one of the line contact, the neutral contact, or the ground contact.

In the present embodiment, the two or more contact flanges of contact set 1921 comprise contact flanges 19211-19214, and the two or more contact flanges of contact set 1922 comprise contact flanges 19221-19224. Perimeters 1931 and 1932 are imaginary, because the perimeters of contact sets 1921 and 1922 do not form a solid ring and are instead composed of discrete contact flanges 19211-19214 and 19221-19224. Central contact 1923 is located within perimeter 1931 of contact set 1921. In addition, perimeter 1931 of contact set 1921 is located within perimeter 1932 of contact set 1922. Central contact 1923, contact set 1921, and contact set 1922 are electrically isolated from each other in rotation coupler 1920.

As illustrated in FIGS. 20-22, electrical connector 1900 further comprises prong adapters 2030 (FIG. 21) and 2040 (FIG. 22), similar to prong adapter 330 of electrical connector 100 (FIGS. 5-6). Prong adapter 2030 is removable from rotation coupler 1920 and replaceable with prong adapter 2040 in the present example. There can be other embodiments, however, where electrical connector 1900 comprises only one of prong adapters 2030 or 2040. Electrical connector 1900 also comprises locking mechanism 760 in the present embodiment, as described above with respect to FIGS. 6-7.

Prong adapter 2030 comprises prong set 2031, having at least two of prong 20311, prong 20312, and prong 20313 accessible at rear 2033 of prong adapter 2030. In some examples, portions of prongs 20311-20313 accessible at rear 2033 can be referred to as couplers. Prong 20311 is configured to couple with contact set 1921 of rotation coupler 1920, and can comprise one of a line prong, a neutral prong, and/or a ground prong, similar to as described for electrical connector 100 above. Prong 20312 is configured to couple with contact set 1922 of rotation coupler 1920, and can comprise a different one of the line prong, the neutral prong, and/or the ground prong. Finally, prong 20313 is configured to couple with central contact 1923, and can comprise another one of the line prong, the neutral prong, and/or the ground prong. In the present example, all three prongs are present in prong set 2031.

Prong adapter 2040 is similar to prong adapter 2030, and is also configured to couple to rotation coupler 1920. As a result, prong adapter 2040 is interchangeable with prong adapter 2030 to couple to rotation coupler 1920. Prong adapter 2040 comprises prong set 2041 with at least two of a line prong, a neutral prong, and/or a ground prong. Similar to prong set 2031 of prong adapter 2030, the prongs of prong set 2041 are configured to protrude and/or be accessible at rear 2033 of prong adapter 2040 at points with radial alignments similar to those discussed above for prong adapter 2030 and corresponding to their respective contacts at rotation coupler 1920. As a result, the line prong, the neutral prong, and/or the ground prong of prong set 2041 are configured to couple with their respective line contact, neutral contact, and ground contact of rotation coupler 1920.

As illustrated in FIGS. 21-22, the shape and arrangement of the prongs on both prong sets 2031 and 2041 differ as they protrude from the front side of prong adapters 2030 and 2040, respectively. In the present example, prong adapter 2030 is configured to be compliant with a first AC prong standard for Australia. Similarly, prong adapter 2040 is configured to be compliant with a second AC prong standard for the United States. Nevertheless, the positional relationship of the prongs at the rear side of both prong adapters 2030 and 2040 is substantially constant in both cases. This arrangement allows flexibility when traveling abroad, permitting the use of electrical connector 1900 on electrical sources of different countries having different AC prong standards by simply coupling the appropriate prong adapter to rotation coupler 1920. As a result, the descriptions herein with respect to prong set 2031 can also be applicable with respect to prong set 2041.

As can be seen in FIGS. 20-22, the different prongs of prong set 2031 are accessible through rear 2033 of prong adapter 2030 in a manner similar to that described above for prong adapter 1730 (FIG. 18), where the different prongs are routed internally to protrude at rear 2033 at locations corresponding to their respective contacts in rotation coupler 1920 (FIG. 19). A similar arrangement is exhibited by prong adapter 2040 through rear 2033, but with respect to prongs set 2041. In the present example, prong 20311 is accessible through an opening at rear 2033 of prong adapter 2030 at a distance of radius 1941 from the center of prong adapter 2030. Because the locations for both prong 20311 and contact set 1921 (FIG. 19) are defined by the same radius 1941, both elements are complementary to each other. As a result, the two or more contact points of contact set 1921 are capable of coupling to only prong 20311 of prong set 2031 when prong adapter 2030 is locked to rotation coupler 1920 by locking mechanism 760.

Similarly, prong 20312 is accessible through an opening at rear 2033 of prong adapter 2030 at a distance of radius 1942 from the center of prong adapter 2030. Because the locations for both prong 20312 and contact set 1922 (FIG. 19) are defined by the same radius 1942, both elements are complementary to each other. As a result, the two or more second contact points of contact set 1922 are capable of coupling to only prong 20312 when prong adapter 2030 is locked to rotation coupler 1920 by locking mechanism 760.

Finally, prong 20313 is accessible through an opening at the center of the rear 2033 of prong adapter 2030, and is thus complementary to central contact 1923, located at the center of rotation coupler 1920 (FIG. 19). As a result, central contact 1923 is capable of coupling to only prong 20313 of prong set 2031 when prong adapter 2030 is locked to rotation coupler 1920 by locking mechanism 760.

Prong adapter 2030 further comprises in the present example one or more safety guards 2032 at rear 2033 configured to at least partially cover one or more of the line prong, the neutral prong, and the ground prong as assigned to prongs 20311-20312. Safety guards 2032 are configured to allow access for the different contacts flanges 19211-19214 and/or 19221-19224 of rotation coupler 1920 to couple with their respective prongs of prong set 2031, while making it harder for users to contact prong set 2031 with their hands or other objects. For example, safety guard 20321 can comprise a wall of channel 20325 over prong 20311, where channel 20325 can channel contact flanges 19211-19214 over prong 20311 when prong adapter 2033 is secured to and rotated relative to rotation coupler 1920. Safety guards 2032 can be portions of a circle and can fit between contact set 1921 and contact set 1922 in the same or other embodiments.

As implemented for electrical connector 1900 in FIG. 19, locking mechanism 760 comprises securing tab set 764 at a perimeter of rotation coupler 1920. Securing tab set 764 is also employed in other embodiments herein described, as seen in FIGS. 4 and 7, for example. Securing tab set 764 comprises one or more securing tabs, such as securing tab 7641, separated by one or more securing notches, such as securing notch 7645 in the present example. In addition, as seen in FIG. 20, locking mechanism 760 also comprises tab set 765 and 766 at a perimeter of prong adapter 2030. Tab sets 765 and 766 are also employed in other embodiments herein described, as seen in FIGS. 5, 6, and 23, for example. Tab set 765 comprises one or more tabs, such as tab 7651, separated by one or more notches, such as notch 7655. Similarly, tab set 766 comprises one or more tabs, such as tab 7661, separated by one or more notches, such as notch 7665. In the present example, lock receivers 7621-7624 are located at tab set 765, and tab set 765 is separated from tab set 766 by at least a thickness of the securing tabs or securing tab set 764 (FIG. 19).

The one or more notches of tab set 765 are vertically aligned with the one or more tabs of tab set 766, and the one or more notches or tab set 766 are vertically aligned with the one or more tabs of tab set 765. As a result, prong adapter 2030 may not be inserted into or removed from rotation coupler 1920 in a single movement. Instead, a series of movements may be required for inserting and/or removing prong adapter 2030 from rotation coupler 1920. Such series of movements may be beneficial, for example, to prevent or restrict unwanted separation of prong adapter 2030 from rotation coupler 1920.

To couple prong adapter 2030 (FIG. 20) with rotation coupler 1920 (FIG. 19) in the present example, the one or more tabs of tab set 765 at prong adapter 2030 can be first inserted into rotation coupler 1920 through the securing notches of securing tab set 764 until the one or more tabs of tab set 766 at prong adapter 2030 contact the one or more tabs of securing tab set 764 over rotation coupler 1920. Prong adapter 2030 can then be rotated until the one or more tabs of tab set 766 are aligned with the one or more securing notches of securing tab set 764, at which point prong adapter 2030 can be further inserted into rotation coupler 1920 until the one or more tabs of tab set 766 lie within rotation coupler 1920 beneath tab set 764. Prong adapter 2030 can then be further rotated until the one or more tabs of tab set 766 are coupled beneath and vertically aligned with the one or more tabs of securing tab set 764 to secure prong adapter 2030 with rotation coupler 1920. In some embodiments, lock deactuator 763 may be pressed to decouple or withdraw lock 761 and thereby permit tab set 766 to couple beneath and vertically align with securing tab set 764. In such embodiments, lock deactuator 763 can then be released to permit lock 761 to couple with one of lock receivers 7621-7624 and thereby restrict the rotational movement of prong adapter 2030 relative to rotation coupler 1920.

In the present example, and in embodiments where prong adapter 2030 comprises prong 20311 of prong set 2031, because of the radial alignments described above, when prong adapter 2030 (FIG. 20) is locked to rotation coupler 1920 (FIG. 19) by the latching of locking mechanism 760 (FIGS. 7 and 19) to any of lock receivers 7621-7624 (FIG. 20), at least one of contact points 19211-19214 of contact set 1921 couples with prong 20311.

Similarly, in the present example, and in embodiments where prong adapter 2030 comprises prong 20312 of prong set 2031, again because of the radial alignments described above, when prong adapter 2030 (FIG. 20) is locked to rotation coupler 1920 (FIG. 19) by the latching of locking mechanism 760 (FIGS. 7 and 19) to any of lock receivers 7621-7624 (FIG. 20), at least one of contact flanges 19221-19224 of contact set 1922 couples with prong 20311.

Finally, in the present example, and in embodiments where prong adapter 2030 comprises prong 20313 of prong set 2031, when prong adapter 2030 (FIG. 20) is coupled to rotation coupler 1920 (FIG. 19), central contact 1923 couples to prong 20313.

As seen in FIG. 19, in the present example contact set 1922 comprises two or more cantilever arms 19225-19228, such that contact flanges 19221-19224 are respectively located at outer ends of cantilever arms 19225-19228. In the present example, the cantilever arms of contact set 1922 extend outwards from a first central junction located at least partially around central contact 1923. In one example, central contact 1923 can be insulated from the first central junction of contact set 1922 via insulating structure 19231, where insulating structure 19231 comprises an insulating material such as plastic. There can be embodiments where the first central junction, contact flanges 19221-19224, and cantilever arms 19228-19228 comprise a single piece.

In the present embodiment, contact set 1921 also comprises two or more cantilever arms similar to cantilever arms 19225-19228 of contact set 1922. The cantilever arms of contact set 1921, however, differ from the cantilever arms of contact set 1922 in that they extend inwards, from a peripheral junction outside perimeter 1932, towards a center of rotation coupler 1920. As a result, contact flanges 19211-19214 are respectively located at inner ends of the cantilever arms of contact set 1921. There can be embodiments where the peripheral junction, contact flanges 19211-19214, and the two or more cantilever arms of contact set 1921 comprise a single piece.

In other embodiments, contact set 1921 can comprise two or more cantilever arms similar to cantilever arms 19225-19228 of contact set 1922, where the cantilever arms of contact set 1921 also extend outwards with respect to central contact 1923. As a result, contact flanges 19211-19214 are respectively located at outer ends of the cantilever arms of contact set 1921 in such embodiments. In the same or other embodiments, the cantilever arms of contact set 1921 can be coupled together at a second central junction similar to the first central junction of contact set 1921, where the second central junction can also be located at least partially around central contact 1923. In such embodiments, the first and second central junctions can be located and/or stacked around insulating structure 19231, separated from each other by, for example, an insulating spacer. In the same or other embodiments, the insulating spacer can be part of insulating structure 19231. There can also be embodiments where only one of contact sets 1921 or 1922 comprises cantilever arms.

Due to their inherent cantilever characteristics, the cantilever arms of contact sets 1921 and/or 1922 can tend to resist elastic deformation when loaded towards their outer ends at any of contact flanges 19211-19214 or 19221-19224. As a result, for example, when rear 2033 of any of prong adapters 2030 or 2040 is pushed against contact flanges 19211-19214 and/or 19221-19224 during coupling with rotation coupler 1920, the cantilever arms of contact sets 1921 and 1922 will tend to resist elastic deformation by cantilevering contact flanges 19211-19214 and/or 19221-19224 against rear 2030. This can be beneficial, for example, to simplify the design and/or manufacture of electrical connector 1900 by avoiding the need to resort to other devices, such as springs, to maintain the contact between contact sets 1921 and 1922 against prong set 2031 of prong adapter 2030. In the present embodiment, when prong adapter 2030 is secured to rotation coupler 1920 as described above, at least one of the cantilever arms of contact set 1921 can cantilever at least one of contact flanges 19211-19214 against prong 20311 at rear 2033 to thereby establish electrical contact. Similarly, at least one of the cantilever arms of contact set 1922 can cantilever at least one of contact flanges 19221-19224 against prong 20312 at rear 2033 to thereby establish electrical contact.

In the present example, the contact arms and flanges of contact sets 1921 and 1922 are staggered in a circular pattern relative to each other around central contact 1923. In addition, the contact flanges 19211-19214 are evenly separated relative to each other around a circular pattern defined by perimeter 1931. Contact flanges 19221-19224 are also evenly separated relative to each other around a circular pattern defined by perimeter 1932. In addition, contact flanges 19211-19214 are evenly separated relative to contact flanges 19221-19224. As an example, in the present embodiment, contact flanges 19221-19221 are separated from each other by approximately 90 degrees, such that flange 19211 is separated from flanges 19212-19214 by approximately 90 degrees, approximately 180 degrees, and approximately degrees, respectively. Similarly, flange 19221 is separated from flanges 19222-19224 by approximately 90 degrees, approximately 180 degrees, and approximately 270 degrees, respectively. In addition, flange 19211 is separated from flange 19221 by approximately 45 degrees.

There can be other embodiments comprising a different number of flanges per flange set. For example, one embodiment (not shown) could comprise a first contact flange set similar to contact set 1921 but comprising only first, second and third contact flanges, where the first contact flange is separated from the second and third contact flanges by approximately 120 degrees and approximately 240 degrees, respectively. The same embodiment can comprise a second contact flange set similar to contact set 1922 but comprising only fourth, fifth, and sixth contact flanges, where the fourth contact flange is separated from the fifth and sixth contact flanges by approximately 120 degrees and approximately 240 degrees, respectively, and where the first contact flange is separated from the fourth contact flange by approximately 60 degrees.

Figure 24:
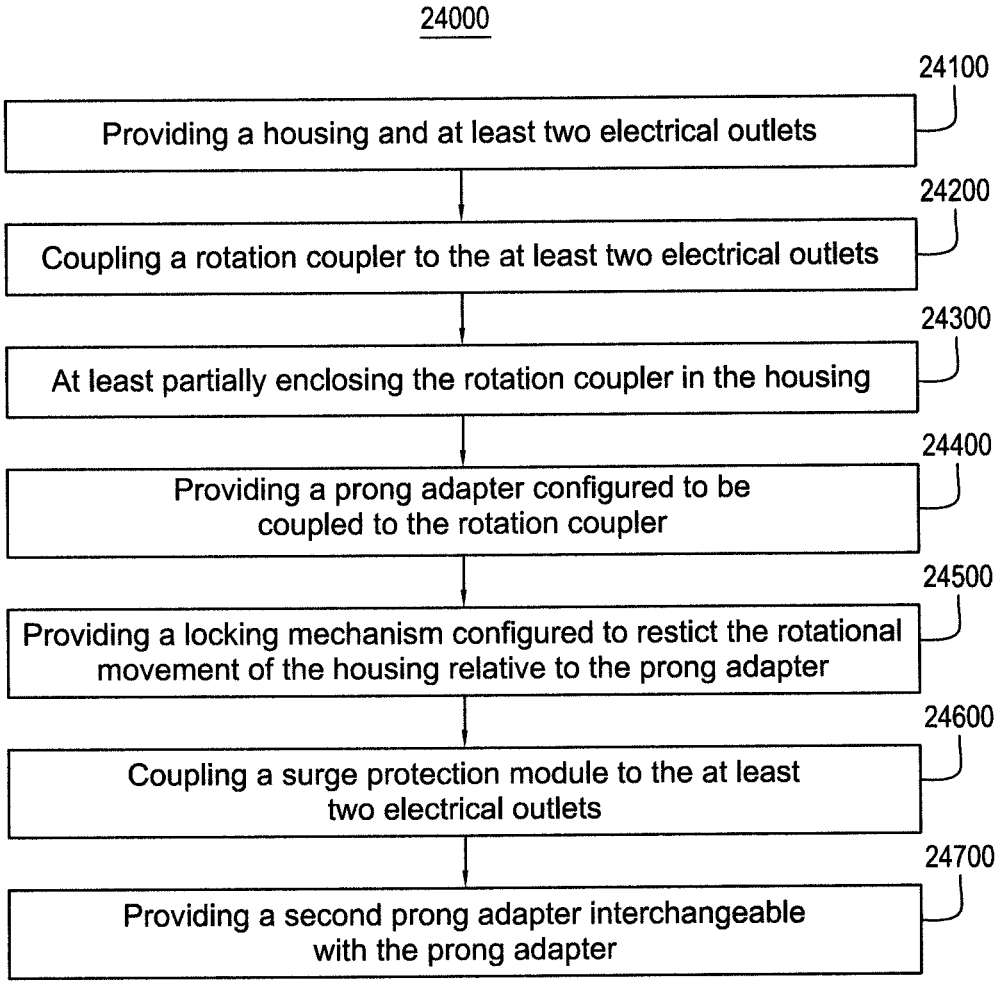
FIG. 24 illustrates a flowchart of a method of manufacturing an electrical connector.

Continuing with the figures, FIG. 24 illustrates a flowchart of a method 24000 for manufacturing an electrical connector. The electrical connector in method 24000 can comprise, for example, electrical connector 100 of FIGS. 1-5, electrical connector 1600 of FIGS. 16-18, and electrical connector 1900 of FIGS. 19-21.

For method 24000, manufacturing the electrical connector can comprise making the electrical connector available to purchasers or users, for example, by the manufacturer of the electrical connector, distributors, marketers, or resellers. The electrical connector can be made available via wholesale distribution methods, and/or through retail networks that cater to midstream parties or end users.

Block 24100 of method 24000 involves providing a housing and at least two electrical outlets. As an example the housing can be housing 110 as shown and described for electrical connector 100 (FIGS. 1-4, and 7-15), housing 110 as shown and described for electrical connector 1900 (FIG. 19), or a similar housing or case from any of the electrical adapters described above. Similarly, the at least two electrical outlets can comprise any of the electrical outlets described above for the different electrical connectors, including AC outlets, USB outlets, Ethernet outlets, and/or telephone jacks. The at least two outlets can be coupled to the housing such that they are accessible externally through the case, while having provisions for connections internally to the housing.

Block 24200 of method 24000 involves coupling a rotation coupler to the at least two electrical outlets. In some examples, block 24200 can comprise providing the rotation coupler before coupling to the at least two electrical outlets. In one example, the rotation coupler can be similar to rotation coupler 420 (FIG. 4) from electrical connector 100, to rotation coupler 1920 (FIG. 19) of electrical connector 1900, or to any rotation coupler or coupling section from any of the electrical connectors described above, and can comprise a line contact, a neutral contact, and a ground contact. The rotation coupler of block 24200 is coupled to the at least two electrical outlets described in block 24100 internally to the housing. In some examples, providing the rotation coupler in block 24200 can comprise providing a first flange set and a second flange set arranged relative to a central contact of the rotation coupler, as described above with respect to contact sets 1921-1922 relative to central contact 1923 of rotation coupler 1920 (FIG. 19)

Block 24300 of method 24000 involves at least partially enclosing the rotation coupler in the housing. As an example, the rotation coupler can be partially enclosed as illustrated for rotation couplers 1620 and 1920 in FIGS. 16 and 19, respectively, wherein the rotation coupler is secured by the housing while leaving an opening for the line, neutral, and ground contacts accessible to the exterior of the housing.

Block 24400 of method 24000 involves providing a prong adapter configured to be coupled to the rotation coupler. In one example, the prong adapter can be similar to prong adapter 330 (FIG. 3) of electrical connector 100 in FIGS. 1-15, to one or both of prong adapters 2030 or 2040 (FIGS. 20-22) of electrical connector 1900 (FIG. 19), or to any other prong adapter described above for other electrical connectors. The prong adapter comprises a prong set comprising at least two of a line prong, a neutral prong, and a ground prong, similar to as described for other prong adapters above. The prong adapter of block 24400 couples to the rotation coupler through the opening at the exterior of the housing described in block 24300. When the prong adapter and the rotation coupler of method 24000 are coupled together, the line contact couples to the line prong, and the neutral contact couples to the neutral prong. In addition, in embodiments comprising a ground prong, the ground contact couples to the ground prong. The rotation coupler of method 24000 is also configured to allow a rotational movement of the housing relative to the prong adapter when the prong adapter is coupled to the rotation coupler, similar to the rotational movement described above for electrical connector 100 with respect to FIGS. 8-15 and/or for electrical connector 1900 with respect to FIGS. 19-22.

In some examples, providing the first and/or second flange sets in block 24200 can comprise providing cantilever arms to cantilever one or more flanges of the first and/or second flange sets when coupling with the prong set of the prong adapter of block 24400. In such examples, the cantilever arms can be similar to the cantilever arms described above for rotation coupler 1920 for contact sets 1921 and/or 1922 (FIG. 19).

Method 24000 can comprise a block 24500, comprising providing a locking mechanism configured to restrict the rotational movement of the housing relative to the prong adapter. The locking mechanism can be similar to locking mechanism 760, as described and/or illustrated above with respect to FIGS. 4-7 for electrical connector 1000, FIGS. 16-18 for electrical connector 1600, FIGS. 19-22 for electrical connector 1900, and/or FIG. 23 for electrical connector 2300.

Method 24000 can also comprise a block 24600, comprising coupling a surge protection module to the at least two electrical outlets. In one example, the surge protection module can be surge protection module 750 as described above for electrical connector 100 in FIG. 7. The surge protector can be contained by the housing, being coupled internally to the housing between the two or more electrical connectors and the rotation coupler.

Method 24000 can further comprise a block 24700, comprising providing a second prong adapter interchangeable with the prong adapter of block 24400. As an example, the second prong adapter can be as described for electrical connector 1900, where second prong adapter 2040 (FIG. 22) is interchangeable with prong adapter 2030 (FIGS. 20-21) for coupling with rotation coupler 1920. The second prong adapter can be compliant with an AC prong standard different than the AC prong standard to which the prong adapter of block 24400 is compliant with.

In one embodiment, blocks 24100, 24200, 24300, 24400, 24500, 24600, and 24700 of method 24000 can be subparts of a single step. In the same or a different embodiment, the sequence of blocks 24100, 24200, 24300, 24400, 24500, 24600, and 24700 of method 24000 can be otherwise changed. Also, blocks 24500, 24600, and 24700 can be optional depending on the specific example of electrical connector being manufactured.

Figure 27:
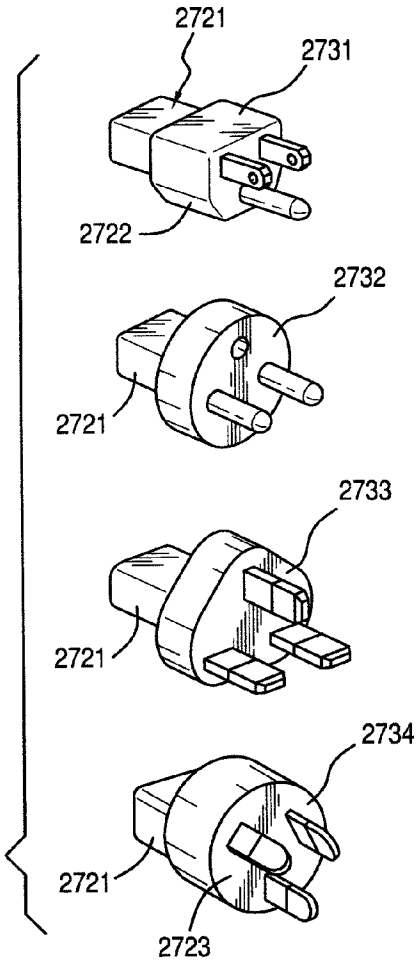
FIG. 27 illustrates a front, side isometric view of exemplary prong adapters of the electrical power adapter of FIG. 25, according to the different embodiment.
Figure 26:
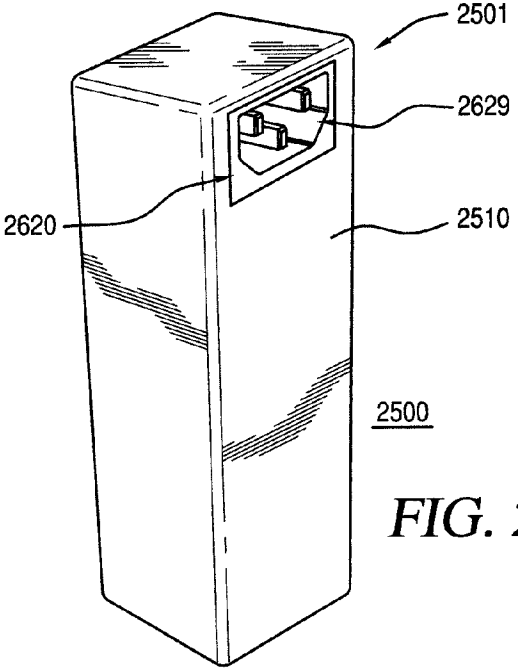
FIG. 26 illustrates a back, top, right side view of the base unit of FIG. 25, according to the different embodiment.
Figure 25:
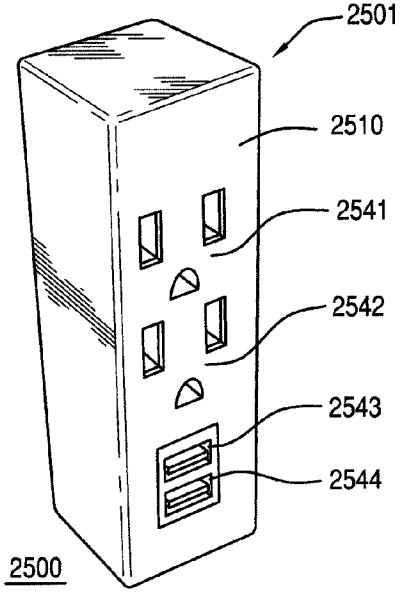
FIG. 25 illustrates a front, top, left side isometric view of an exemplary base unit of an exemplary electrical power adapter, according to a different embodiment.
Figure 28:
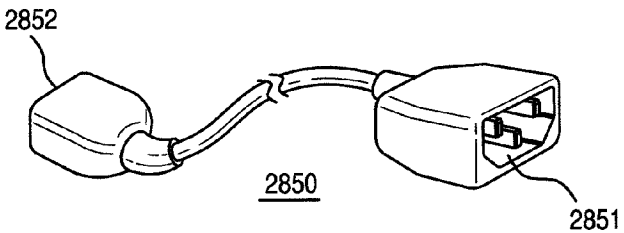
FIG. 28 illustrates an exemplary connector wire of the electrical power adapter of FIG. 25, according to the different embodiment.
Figure 29:
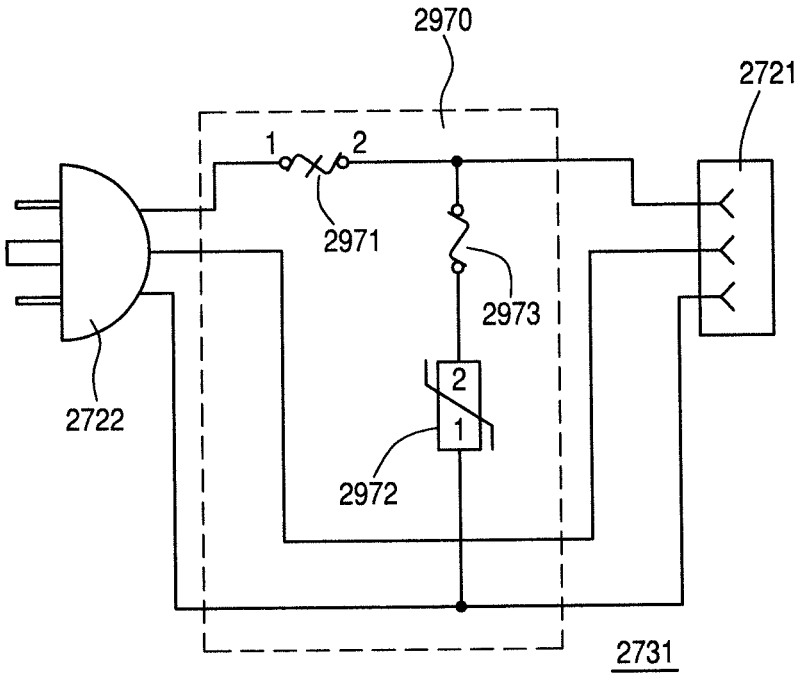
FIG. 29 illustrates a circuit diagram of a prong adapter of FIG. 27, according to the different embodiment.
Figure 30:
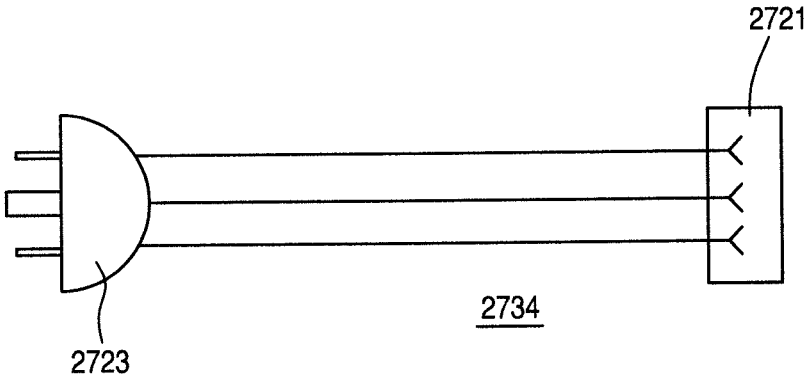
FIG. 30 illustrates a circuit diagram of another prong adapter of FIG. 27, according to the different embodiment.
Figure 31:
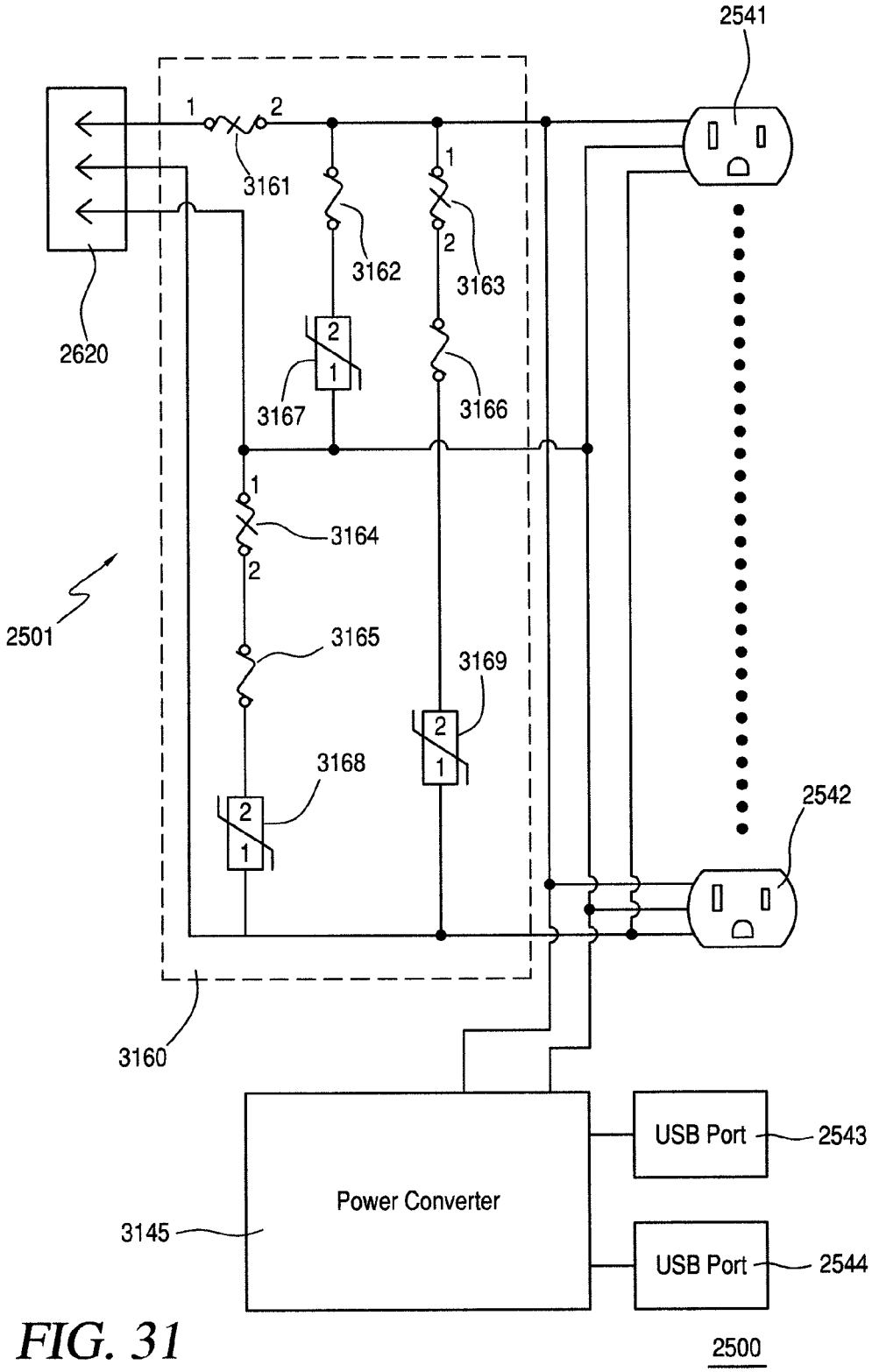
FIG. 31 illustrates a circuit diagram of the base unit of FIG. 25, according to the different embodiment.

Turning to another embodiment, FIG. 25 illustrates a front, top, left side isometric view of a base unit 2501 of an electrical power adapter 2500, according to a different embodiment. FIG. 26 illustrates a back, top, right side view of base unit 2501 of electrical power adapter 2500, according to the different embodiment. FIG. 27 illustrates a front, side isometric view of prong adapters 2731, 2732, 2733, and 2734 of electrical power adapter 2500, according to the different embodiment. FIG. 28 illustrates a connector wire 2850 of electrical power adapter 2500, according to the different embodiment. FIG. 29 illustrates a circuit diagram of prong adapter 2731, according to the different embodiment. FIG. 30 illustrates a circuit diagram of prong adapter 2734, according to the different embodiment. FIG. 31 illustrates a circuit diagram of base unit 2501, according to the different embodiment. Electrical power adapter 2500 is merely exemplary and is not limited to the embodiments presented herein. Electrical power adapter 2500 can be employed in many different embodiments or examples not specifically depicted or described herein.

In various embodiments, electrical power adapter 2500 can be a portable electrical surge protected electrical outlet strip. Electrical power adapter 2500 can be designed specifically to support electrical devices that use universal power supplies. For example, portable computers or other electrical devices such as portable home theater equipment, portable televisions, portable DVD (digital video disc) players, video player, and the like can use universal power supplies.

Universal power supplies allow the electrical devices to accept electrical power at a range of voltages at any standard power line frequency. For example, many universal power supplies allow electrical devices to receive electrical power with a voltage in the range of 85 volts to 265 volts.

Conventional power strips, however, provide electrical power at only a single voltage (e.g., 120 volts or 230 volts). For example, some conventional travel power strips can receive 230 volts when plugged into an electrical wall outlet in a country where electrical power has a voltage of 230 volts. These travel power strips can output 120 volts (i.e., the United States standard electrical power voltage). To convert the electrical voltage, conventional power strips can include step-down transformers, step-up transformers, or other circuitry to transform the incoming voltage into the different output voltage. However, for electrical devices using universal power supplies, this voltage change is usually unnecessary.

Electrical power adapter 2500, on the other hand, is configured such that the output voltage is substantially the same as the input voltage. That is, if electrical power adapter 2500 is coupled to an electrical power source providing AC electrical power at 120 volts, electrical power adapter 2500 outputs AC electrical power at 120 volts. If electrical power adapter 2500 is coupled to an electrical power source providing AC electrical power at 230 volts, electrical power adapter 2500 outputs AC electrical power at 230 volts. Electrical devices utilizing a universal power supply can receive a range of incoming voltages without damaging the electrical devices.

Accordingly, electrical power adapter 2500 can be a more economical power strip or surge protection that can be safely used with electrical devices utilizing universal power supplies when compared to the conventionally available power strips or surge protectors. The conventionally available power strips or surge protectors use unnecessary and unneeded transformers and other circuitry that can be expensive and significantly increase the cost and complexity of the electrical devices.

Additionally, electrical power adapter 2500 can include two or more prong adapters. These prong adapters can facilitate an electrical device with an electrical plug designed to work with an electrical outlet of a first country to be used with an electrical plug of one or more second countries where the standard electrical plug style is different between the first country and the one or more second countries.

Furthermore, electrical power adapter 2500 can be configured to provide different levels of surge protection based on the voltage of the incoming AC electrical power. That is, for low voltage incoming AC current (e.g., 120 volts), electrical power adapter can protect against lower voltage surges (e.g., 200, 300, or 400 volt surges). For high voltage incoming AC current (e.g., 220 or 230 volts), electrical power adapter 2500 can provide protection against only higher voltage surges (e.g., 500, 600, or 700 volt surges) and not the lower voltage surges.

That is, unlike conventional surge protectors, electrical power adapter 2500 can be configured in such a way so that when electrical power adapter 2500, used in the United States (or another low voltage country such as Canada or Mexico), the associated surge protection clamping voltage is lowered, but electrical power adapter 2500 still can provide the higher surge protection clamping voltage if electrical power adapter 2500 is moved to a high voltage country (e.g., Germany, France, United Kingdom, Australia, or New Zealand).

Referring now to FIGS. 25-31, an apparatus for providing electrical power or an electrical power adapter 2500 can include: (a) a base unit 2501; and (b) prong adapters 2731, 2732, 2733, and 2734 (FIG. 27) configured to be removably attached to base unit 2501. In various examples, electrical power adapter 2500 can also include a connector wire 2850 (FIG. 28).

In some embodiments, base unit 2501 can include: (a) a housing 2510 with an interior cavity; (b) one or more electrical outlets 2541 and 2542; (c) an electrical attachment mechanism or an electrical coupler 2620 (FIG. 26) configured to be removably coupled to prong adapters 2731, 2732, 2733, and 2734; (d) electrical connectors 2543 and 2544; (e) a surge protection module 3160 (FIG. 31); and (f) a power converter 3145 (FIG. 31).

Electrical outlets 2541 and 2542 can be located at and accessible through housing 2510. In some examples, electrical outlets 2541 and 2542 can be United States-style electrical outlets (e.g., NEMA (National Electrical Manufacturers Association) 1-15 electrical outlets or NEMA 5-15 electrical outlets)). In other examples, electrical outlets 2541 and 2542 can be electrical outlets of the style used in other countries (i.e., other country-style electrical outlets). For example, electrical outlets 2541 and 2542 can be Schuko or German-style electrical outlets (e.g., CEE (International Commission on the Rules for the Approval of Electrical Equipment) 7/4 electrical outlets), Australian-style or New Zealand-style electrical outlets (e.g., AS/NZS (Australian/New Zealand Standard) 3112 electrical outlets), or United Kingdom-style electrical outlets (e.g., British Standards 136 electrical outlets).

Electrical coupler 2620 can be located at housing 2510 and at least partially enclosed by housing 2510. In the embodiment illustrated in FIG. 31, electrical coupler 2620 is electrically coupled to surge protection module 3160. In other examples, electrical coupler 2620 can be directly coupled to electrical outlets 2541 and 2542.

In the same or different embodiment, electrical coupler 2620 can include a rotation coupler. Accordingly, prong adapters 2731, 2732, 2733, and 2734 can be rotatable 360 degrees relative to housing 2510. In some examples, the rotation coupler can be the same or similar to the rotation couplers described above in reference to FIGS. 1-23.

In many examples, electrical coupler 2620 is electrically coupled to electrical outlets 2541 and 2542 (via surge protection module 3160 or not) such that when prong adapter 2731 is coupled to electrical coupler 2620 and an electrical outlet that is providing electrical power with a first voltage (e.g., 120 volts), electrical outlets 2541 and 2542 receive and output electrical power with the first voltage. Furthermore, electrical coupler 2620 is electrically coupled to electrical outlets 2541 and 2542 (via surge protection module 3160 or not) such that when prong adapter 2734 is coupled to electrical coupler 2620 and an electrical outlet that is providing electrical power with a second voltage (e.g., 220 volts), electrical outlets 2541 and 2542 receive and output electrical power with the second voltage. Moreover, electrical coupler 2620 is electrically coupled to electrical outlets 2541 and 2542 (via surge protection module 3160 or not) such that when prong adapter 2732 (or 2733) is coupled to electrical coupler 2620 and an electrical outlet that is providing electrical power with a third voltage (e.g., 230 volts), electrical outlets 2541 and 2542 receive and output electrical power with the third voltage. That is, the electrical power that is received by electrical coupler 2620 (and/or prong adapters 2731, 2732, 2733. or 2734) is delivered to the load coupled to electrical outlet 2541 or 2542.

Electrical coupler 2620 can include an electrical connector 2629 that is complementary to electrical connector 2721 (FIGS. 27 and 28). In some embodiments, electrical coupler 2620 can include a standardized electrical connector. For example, electrical connector 2629 can be an IEC (International Electrotechnical Commission)-style electrical male connector (e.g., IEC C14 or C16 electrical connector), and electrical connector 2721 can be an IEC-style electrical female connector (e.g., IEC C13 or C15 female connector).

Turning to FIG. 31, surge protection module 3160 can be at least partially located in the interior cavity of housing 2510. Surge protection module 3160 can be electrically coupled to electrical coupler 2620 and electrical outlets 2541 and 2542. Surge protection module 3160 can be configured to protect against voltage spikes or surges above a first spike voltage or first surge voltage. In one example, surge protection module 3160 can be configured to protect against voltage surges above approximately 700 volts.

In some examples, surge protection module 3160 can include: (a) one or more metal oxide varistors (MOVs) 3167, 3168, and 3169; and (b) one or more fuses 3161, 3162, 3163, 3164, 3165, and 3166. MOVs 3167, 3168, and 3169 can be rated at 300 VACrms (Volts AC Root Mean Square). Fuses 3161, 3164, and 3163 can be thermal cutoff fuses rated at 15 amp (109 degrees Celsius). In other examples, other combinations of MOVs, fuses and/or other circuit elements can be used to protect against voltage surges above the first surge voltage instead of the circuit illustrated in FIG. 31.

Power converter 3145 (FIG. 31) can be electrically coupled to the electrical coupler 2620. Power converter 3145 can be configured to convert the incoming AC electrical power into a substantially constant DC (direct current) electrical power and provide the DC electrical power to electrical connectors 2543 and 2544. In many examples, electrical connectors 2543 are USB connectors, and power converter 3145 converts the AC electrical power into five volt DC electrical power. Accordingly, electrical power adapter can provide electrical power to USB and other devices that need DC electrical power in addition to providing AC electrical power. In other examples, power converter 3145 can convert the power to other voltage electrical power.

As illustrated in FIGS. 27 and 29, prong adapter 2731 can include: (a) an electrical connector 2721 configured to removably couple to electrical coupler 2620; (b) a surge protection module 2970; and (c) an electrical plug 2722 configured to couple to an electrical wall outlet (not shown).

Electrical connector 2721 can be complementary to electrical coupler 2620 (FIG. 26). In some embodiments, electrical connector 2721 can include a standardized electrical connector. For example, electrical connector 2629 (FIG. 26) can be an IEC-style electrical male connector (e.g., IEC C14 or C16 electrical connector), and electrical connector 2721 can be an IEC-style electrical female connector (e.g., IEC C13 or C15 female connector).

Prong adapter 2731 is configured to couple to an electrical outlet in a low voltage AC power country (e.g., the United States, Canada, or Mexico). In electrical systems that provide low voltage AC electrical power, the voltage spikes are not as large as the voltage spikes in a high voltage AC electrical power systems. Accordingly, electrical power adapter 2500 can protect against smaller voltage spikes (e.g., 450 volt spike vs. an 800 volt spike) when coupled to electrical systems that provide low voltage AC electrical power.

To provide this additional protection, surge protection module 2970 is configured to work in combination with surge protection module 3160 (FIG. 31) to protect against voltage spikes or surges above a second spike voltage or second surge voltage. In one example, surge protection module 2970 in combination with surge protection module 3160 (FIG. 31) can be configured to protect against voltage surges above approximately 400 volts.

Surge protection module 2970 can include: (a) MOV 2972; and (b) fuses 2971 and 2973. MOV 2972 can be rated at 130 VACrms. Fuses 2971 and 2973 can be thermal cutoff fuses rated at 15 amp (109 degrees Celsius). Fuse 2971 protects against a failure (e.g., due to an excessive surge event, loss of neutral line event, etc.) of MOV 2972.

When prong adapter 2731 is coupled to electrical coupler 2620 (FIG. 26), fuse 2973 and MOV 2972 (and not fuse 2971 which is in series with fuse 3161 (FIG. 31)), are in parallel with fuse 3162 (FIG. 31) and MOV 3167 (FIG. 31), and thereby reduce the effective clamping voltage to about 400 volts in a surge event. In this embodiment, the insertion of the parallel MOV 2972 is placed only in parallel with the main MOV 3167 (FIG. 31), which is across line and neutral wires.

In other embodiments, additional MOVs within prong adapter 2731 could be placed in parallel with the other associated MOVs within base unit 2501. As described above, this addition is accomplished by using a prong adaptor with built in MOVs. But in other embodiments, this addition could be accomplished by the base unit include additional circuitry (including the aforementioned MOVs) to direct the current through a parallel path (including the MOVs) and provide the lower clamping voltage (see e.g., FIGS. 38-41). In these embodiments, moving the MOV circuit to the base unit can allow the removal of fuse 2971. In other examples, other combinations of MOVs, fuses, and/or other circuit elements can be used to protect against voltage surges above the second surge voltage instead of the circuit illustrated in FIG. 31.

Turning to FIGS. 27 and 30, prong adapter 2734 can include: (a) an electrical connector 2721 configured to removably couple to electrical coupler 2620; and (b) an electrical plug 2723 configured to couple to an electrical wall outlet (not shown). Prong adapter 2734 is devoid of a surge protection module. In the example illustrated in FIG. 30, prong adapter is a straight-through adaptor and provides an electrical path which is mechanically compatible with whatever region the adaptor is designed for use within.

In FIG. 27, prong adapters 2732 and 2733 can be similar to prong adapter 2734 except that the electrical plug can have a different style of electrical prongs. In other examples, at least one of prong adapters 2732 and 2733 can be similar to prong adapter 2734 (except for the style of prongs), and at least one of prong adapters 2732 and 2733 can be similar to prong adapter 2731 (except for the style of prongs). That is, in some examples, one or more of prong adapters 2731, 2732, 2733, and 2734 can be configured for use in low voltage countries, and one or more of prong adapters 2731, 2732, 2733, and 2734 can be configured to be used in high voltage countries.

For example, prong adapter 2731 can include a United States-style electrical plug. Prong adapter 2732 can include a Schuko or German-style electrical plug. Prong adapter 2733 can include an United Kingdom-style electrical plug, and prong adapter 2734 can include a New Zealand or Australian-style electrical plug. In other embodiments, one or more of prong adapters 2731, 2732, 2733, and 2734 can include other country-style electrical plugs.

In the same or different embodiments, connector wire 2850 (FIG. 28) can be used to couple base unit 2501 to prong adapters 2731, 2732, 2733, and 2734. For example, electrical connector 2852 (FIG. 28) can couple to electrical connector 2629, and electrical connector 2851 (FIG. 28) can couple to electrical connector 2721 of one of prong adapters 2731, 2732, 2733, or 2734 (see e.g., FIG. 37).

Figure 32:
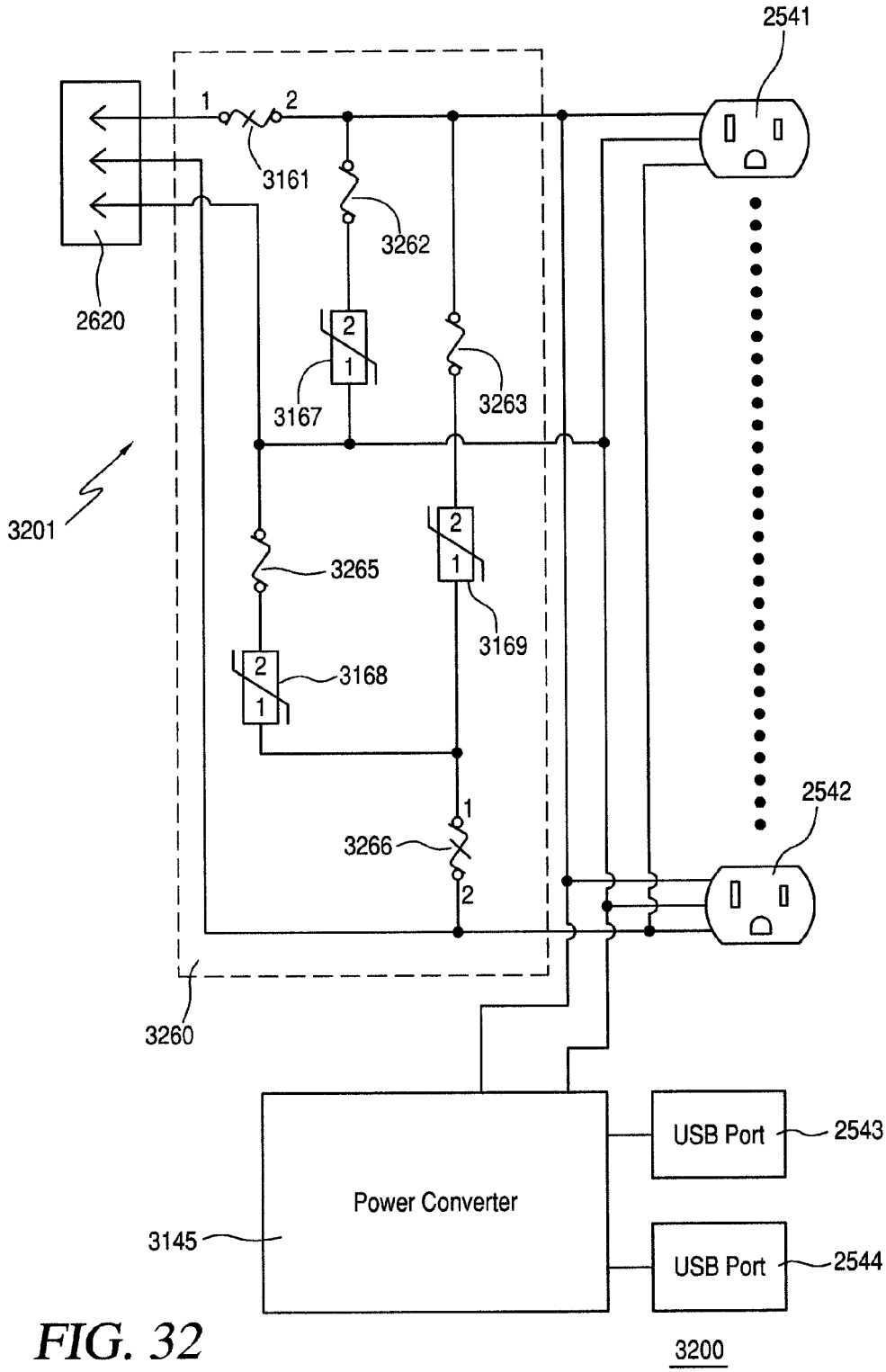
FIG. 32 illustrates a circuit diagram of an exemplary base unit of an exemplary electrical power adapter, according to another embodiment.

FIG. 32 illustrates a circuit diagram of base unit 3201 of an electrical power adapter 3200, according to another embodiment. Electrical power adapter 3200 is merely exemplary and is not limited to the embodiments presented herein. Electrical power adapter 3200 can be employed in many different embodiments or examples not specifically depicted or described herein.

In some examples, base unit 3201 can include a surge protection module 3260. Electrical power adapter 3200 can be similar to electrical power adapter 2500, except that electrical power adapter 3200 includes surge protection module 3260 instead of surge protection module 3160.

Surge protection module 3260 can include: (a) one or more MOVs 3167, 3168, and 3169; and (b) one or more fuses 3161, 3262, 3263, 3265, and 3266. In some examples, fuse 3266 can be thermal cutoff fuses rated at 15 amp (109 degrees Celsius). In other embodiments, fuses 3262, 3263, 3265, and/or 3266 can be thermal cutoff fuses rated at 15 amp (109 degrees Celsius). In other examples, other combinations of MOVs, fuses and/or other circuit elements can be used to protect against voltage surges instead of the circuit illustrated in FIG. 32.

Surge protection module 3260 is different from surge protection module 3160 because surge protection module 3260 contains one less fuse and a different circuit layout. Because of the lower part count, electrical power adapter 3200 can be less expensive to manufacture than electrical power adapter 2500. Surge protection module 3260 provides the same surge protection for electrical power adapter 3200 as surge protection module 3160 provides to electrical power adapter 2500.

Figure 33:
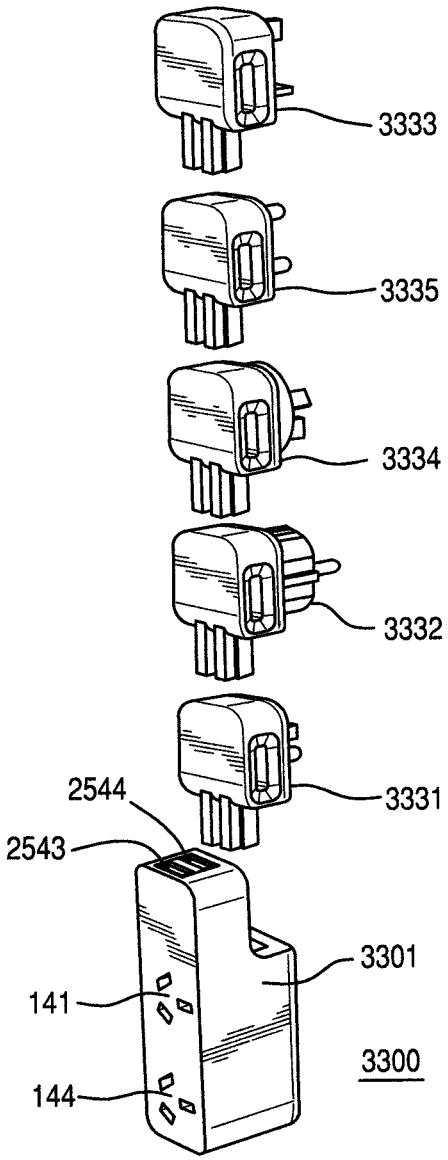
FIG. 33 illustrates a front, right side view of an exemplary base unit of an exemplary electrical power adapter and exemplary prong adapters of the exemplary electrical power adapter, according to a further embodiment.
Figure 34:
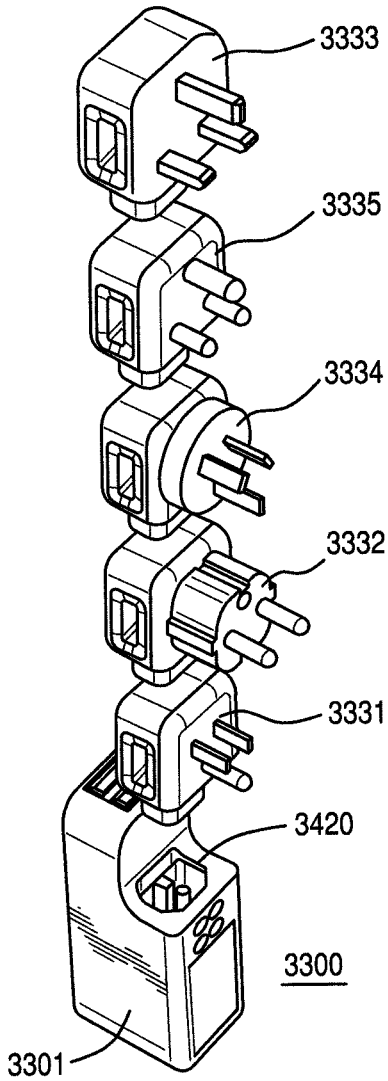
FIG. 34 illustrates a back, top, right side isometric view of the base unit of FIG. 33 and the prong adapters of FIG. 33, according to the further embodiment.

FIG. 33 illustrates a front, right side view of base unit 3301 of electrical power adapter 3300 and prong adapters 3331, 3332, 3333, 3334, and 3335 of electrical power adapter 3300, according to a further embodiment. FIG. 34 illustrates a back, top, right side isometric view of base unit 3301 of electrical power adapter 3300 and prong adapters 3331, 3332, 3333, 3334, and 3335 of electrical power adapter 3300, according to the further embodiment. Electrical power adapter 3300 is merely exemplary and is not limited to the embodiments presented herein. Electrical power adapter 3300 can be employed in many different embodiments or examples not specifically depicted or described herein.

Referring to FIGS. 33 and 34, electrical power adapter 3300 can include (a) a base unit 3301 with an electrical coupler 3420; and (b) prong adapters 3331, 3332, 3333, 3334, and 3335. Electrical power adapter 3300 can be similar to electrical power adapters 2500 and 3200, except base unit 3301, electrical coupler 3420, and prong adapters 3331, 3332, 3333, 3334, and 3335 can have a different body style. Furthermore, electrical outlets 141 and 144 can be New Zealand or Australian-style electrical outlets.

Figure 35:
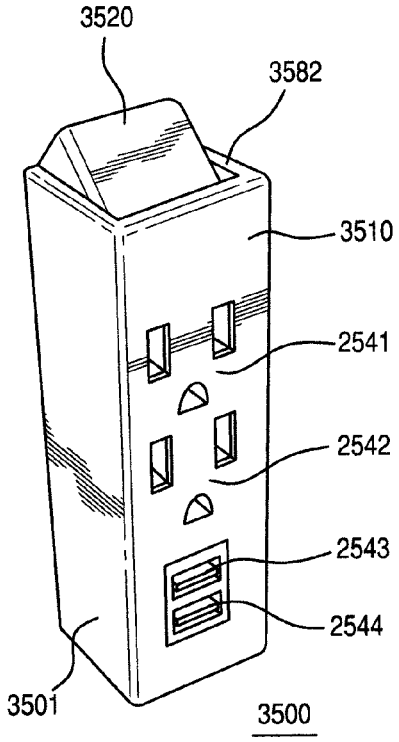
FIG. 35 illustrates a front, top, left side isometric view of an exemplary base unit of an exemplary electrical power adapter, according to a still further embodiment.
Figure 36:
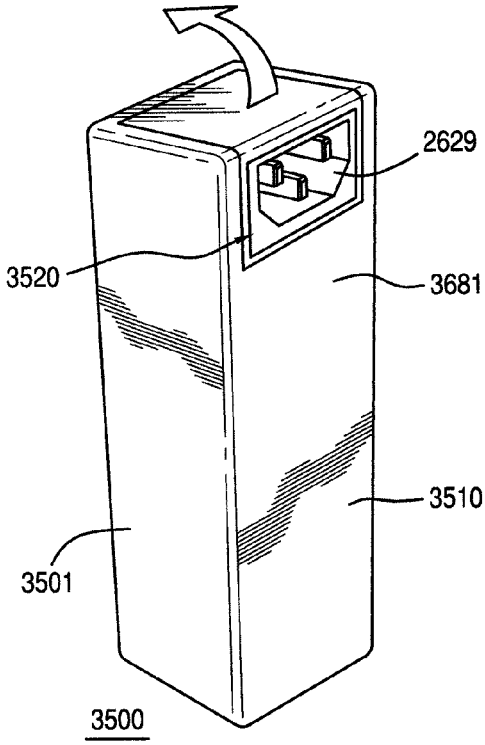
FIG. 36 illustrates a back, top, right side view of the base unit of FIG. 35.
Figure 37:
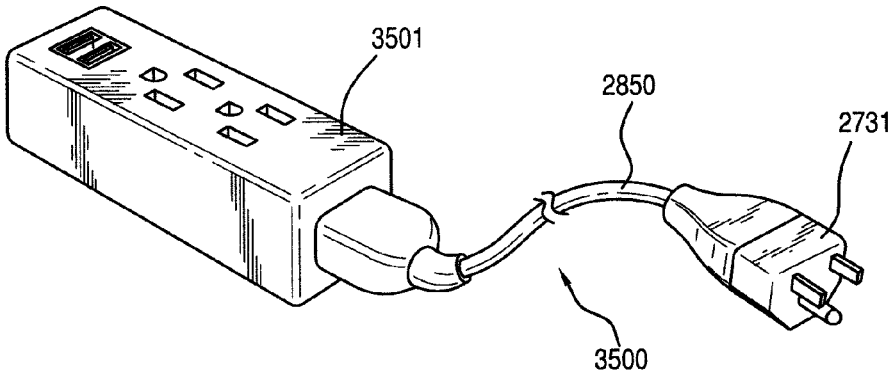
FIG. 37 illustrates a front, right side isometric view of the base unit of FIG. 35, the connector wire of FIG. 28, and the prong adapter of FIG. 29 coupled together.

Turning to another embodiment, FIG. 35 illustrates a front, top, left side isometric view of a base unit 3501 of an electrical power adapter 3500, according to a still further embodiment. FIG. 36 illustrates a back, top, right side view of base unit 3501 of electrical power adapter 3500. FIG. 37 illustrates a front, side isometric view of base unit 3501, connector wire 2850, and prong adapter 2731 coupled together. Electrical power adapter 3500 is merely exemplary and is not limited to the embodiments presented herein. Electrical power adapter 3500 can be employed in many different embodiments or examples not specifically depicted or described herein.

Referring to FIGS. 35-37, electrical power adapter 3500 can include: (a) a base unit 3501; and (b) prong adapters 2731, 2732, 2733, and 2734 (FIG. 27) configured to be removably attached to base unit 3501. In various examples, electrical power adapter 3500 can also include a connector wire 2850 (FIG. 28).

In some embodiments, base unit 3501 can include: (a) a housing 3510 with an interior cavity and sides 3681 and 3582; (b) one or more electrical outlets 2541 and 2542; (c) electrical coupler 3520 with an electrical connector 2629 and configured to be removably coupled to prong adapters 2731, 2732, 2733, and 2734 (FIG. 27); (d) electrical connectors 2543 and 2544; (e) a surge protection module 3160 (FIG. 31); and (f) a power converter 3145 (FIG. 31).

Electrical power adapter 3500 can be similar to electrical power adapter 2500, 3200, and/or 3300 except that electrical coupler 3520 is rotatable relative to housing 2510. In some examples, electrical coupler can be rotated approximately ninety degrees relative to housing 3510. In one example, electrical coupler 3520 can be rotated from a first position where electrical connector 2629 is at side 3681 to a second position where electrical connector 2629 is at side 3582. In another example, electrical coupler 3520 can be rotated 180 degrees with reference to side 3681.

As illustrated in FIG. 37, electrical power adapter 3500 can form a horizontal surge protector when electrical connector 2629 is at side 3582 and when connector wire 2850 is coupled to base unit 3501 and one of prong adapters 2731, 2732, 2733, and 2734.

Figure 38:
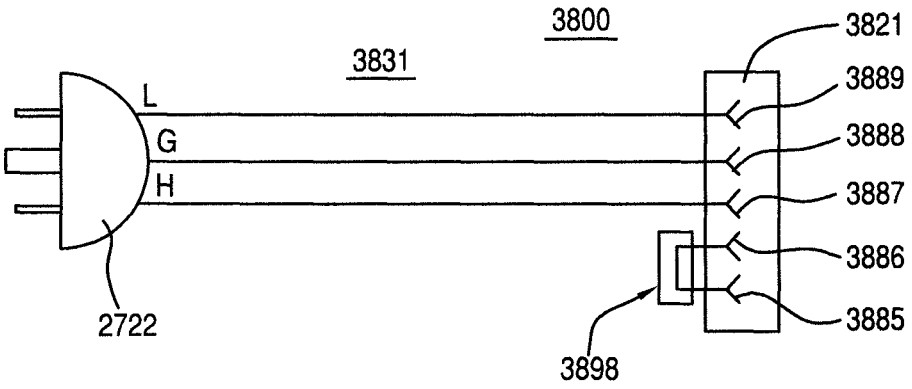
FIG. 38 illustrates a circuit diagram of an exemplary prong adapter of an exemplary electrical power adapter, according to another embodiment.
Figure 39:
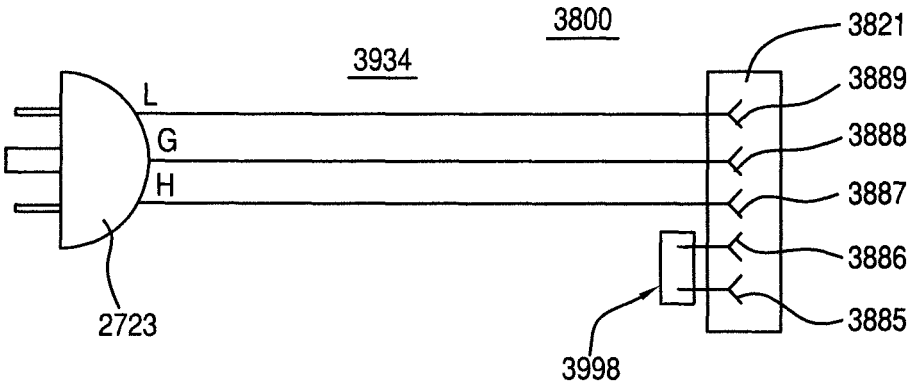
FIG. 39 illustrates a circuit diagram of another exemplary prong adapter of the electrical power adapter of FIG. 38.
Figure 40:
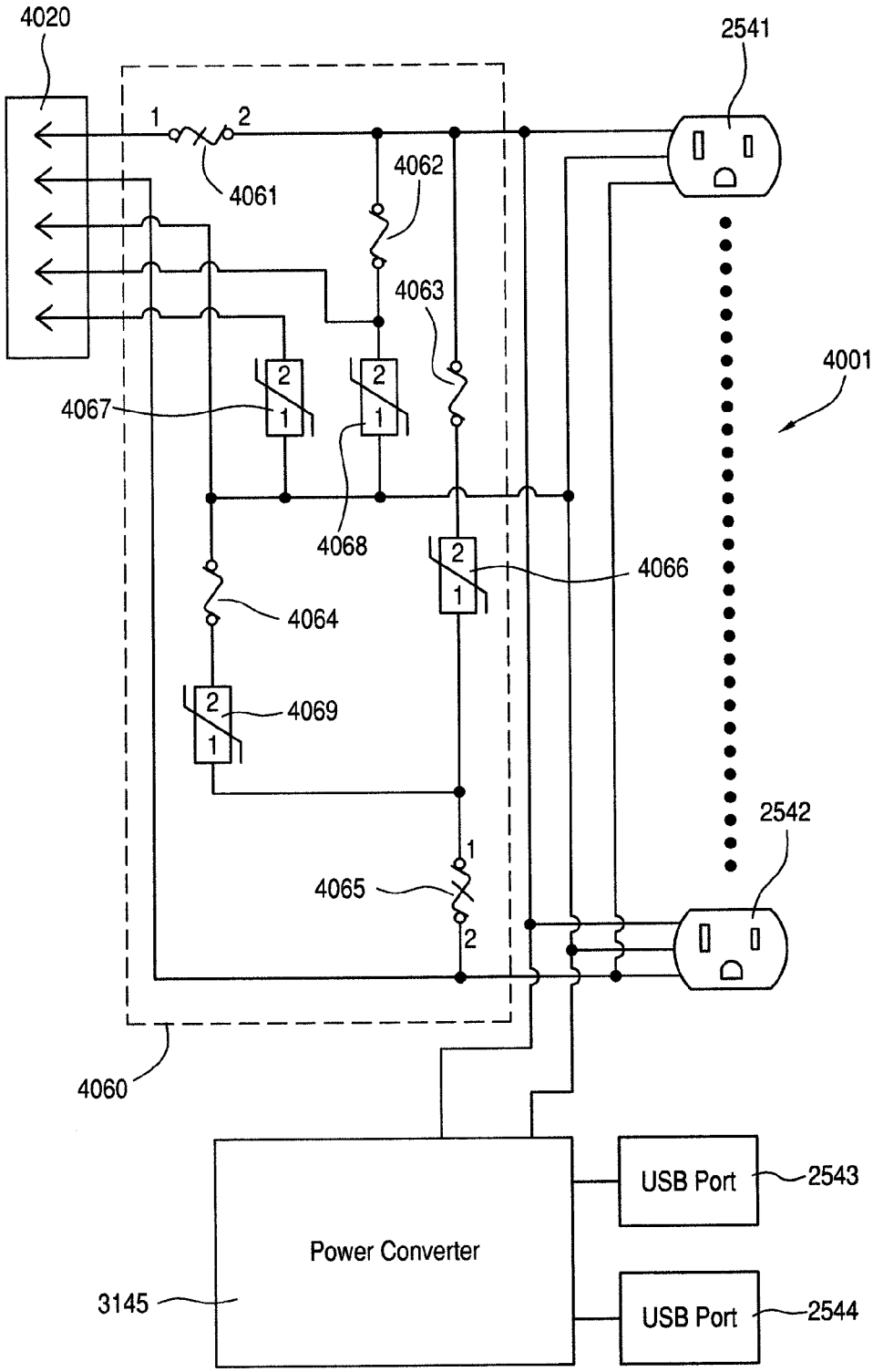
FIG. 40 illustrates a circuit diagram of an exemplary base unit of the electrical power adapter of FIG. 38.

Turning to yet other embodiments, FIG. 38 illustrates a circuit diagram of a prong adapter 3831 of an electrical power adapter 3800, according to another embodiment. FIG. 39 illustrates a circuit diagram of a prong adapter 3934 of electrical power adapter 3800. FIG. 40 illustrates a circuit diagram of a base unit 4001 of electrical power adapter 3800. Electrical power adapter 3800 is merely exemplary and is not limited to the embodiments presented herein. Electrical power adapter 3800 can be employed in many different embodiments or examples not specifically depicted or described herein.

In the embodiment illustrated in FIGS. 38-40, the surge protection module for the low voltage countries is not located in the prong adapter. Rather, base unit 4001 includes a surge protection module 4060 that provides high voltage spike protection (e.g., above 700 volts) in high voltage countries and provides low voltage spike protection (e.g., above 400 volts) in low voltage countries. In these examples, the prong adapters (e.g., prong adapter 3934) can include an enabling mechanism 3898 (or 3998) to enable (or disable) the low voltage spike protection.

Referring to FIGS. 38-40, electrical power adapter 3800 can include: (a) a base unit 4001; and (b) two or more prong adapters 3831 and 3934 configured to be removably attached to base unit 4001.

In some embodiments, base unit 4001 can include: (a) a housing (not shown) with an interior cavity; (b) one or more electrical outlets 2541 and 2542; (c) electrical coupler 4020 configured to be removably coupled to prong adapters 3831 and 3934; (d) electrical connectors 2543 and 2544; (e) a surge protection module 4060; and (f) a power converter 3145 (FIG. 31).

Prong adapter 3831 can include: (a) an electrical connector 3821 configured to removably couple to electrical coupler 4020; and (b) an electrical plug 2722 configured to couple to an electrical wall outlet (not shown). In some examples, electrical connector 3821 can include five prongs or wires 3885, 3886, 3887, 3888, and 3889. Wires 3889, 3888, and 3887 can be coupled to the line, ground, and neutral lines, respectively, of electrical plug 2722 in various embodiments. Wires 3885 and 3886 can be coupled together to form the enabling mechanism 3898 in the same or different embodiments.

Prong adapter 3934 can include: (a) an electrical connector 3821 configured to removably couple to electrical coupler 4020; and (b) an electrical plug 2723 configured to couple to an electrical wall outlet (not shown). In some examples, electrical connector 3821 can include five prongs or wires 3885, 3886, 3887, 3888, and 3889. Wires 3889, 3888, and 3887 can be coupled to the line, ground, and neutral lines, respectively, of plug 2723 in various embodiments. Wires 3885 and 3886 can be coupled to nothing or can be open to form the enabling mechanism 3998 in the same or different embodiments.

In some examples, surge protection module 4060 can include: (a) one or more MOVs 4066, 4067, 4068, and 4069; and (b) one or more fuses 4061, 4062, 4063, 4064, and 4065. MOVs 4066, 4068, and 4069 can be rated at 300 VACrms. MOV 4067 can be rated at 130 VACrms. Fuses 4061 and 4065 can be thermal cutoff fuses rated at 15 amp (109 degrees Celsius). In various embodiments, a first part of a first surge protection module can be considered MOV 4067, and a second surge protection module can be considered MOVs 4066, 4068, and 4069 and fuses 4061, 4062, 4063, 4064, and 4065. Enabling mechanism 3898 (FIG. 38) can be considered a second part of the first surge protection module. In other examples, other combinations of MOVs, fuses and/or other circuit elements can be used to protect against voltage surges instead of the circuit illustrated in FIG. 40.

When prong adapter 3831 (FIG. 38) is coupled to electrical coupler 4020, wires 3885 and 3886 (FIG. 38) complete the circuit coupling MOV 4067 between the line and the neutral wires. Accordingly, the voltage (i.e., the clamping voltage) at which surge protection module 4060 protects against voltage surges above is lowered from the second surge voltage to the first surge voltage (e.g., from 700 volts to 400 volts) because MOV 4067 is in effect in parallel with MOV 4068.

When prong adapter 3934 (FIG. 39) is coupled to electrical coupler 4020, wires 3885 and 3886 (FIG. 39) do not complete the circuit coupling MOV 4067 between the line and the neutral wires. Accordingly, the voltage (i.e., the clamping voltage) at which surge protection module 4060 protects against voltage surges above the second higher voltage (e.g., 700 volts).

Figure 41:
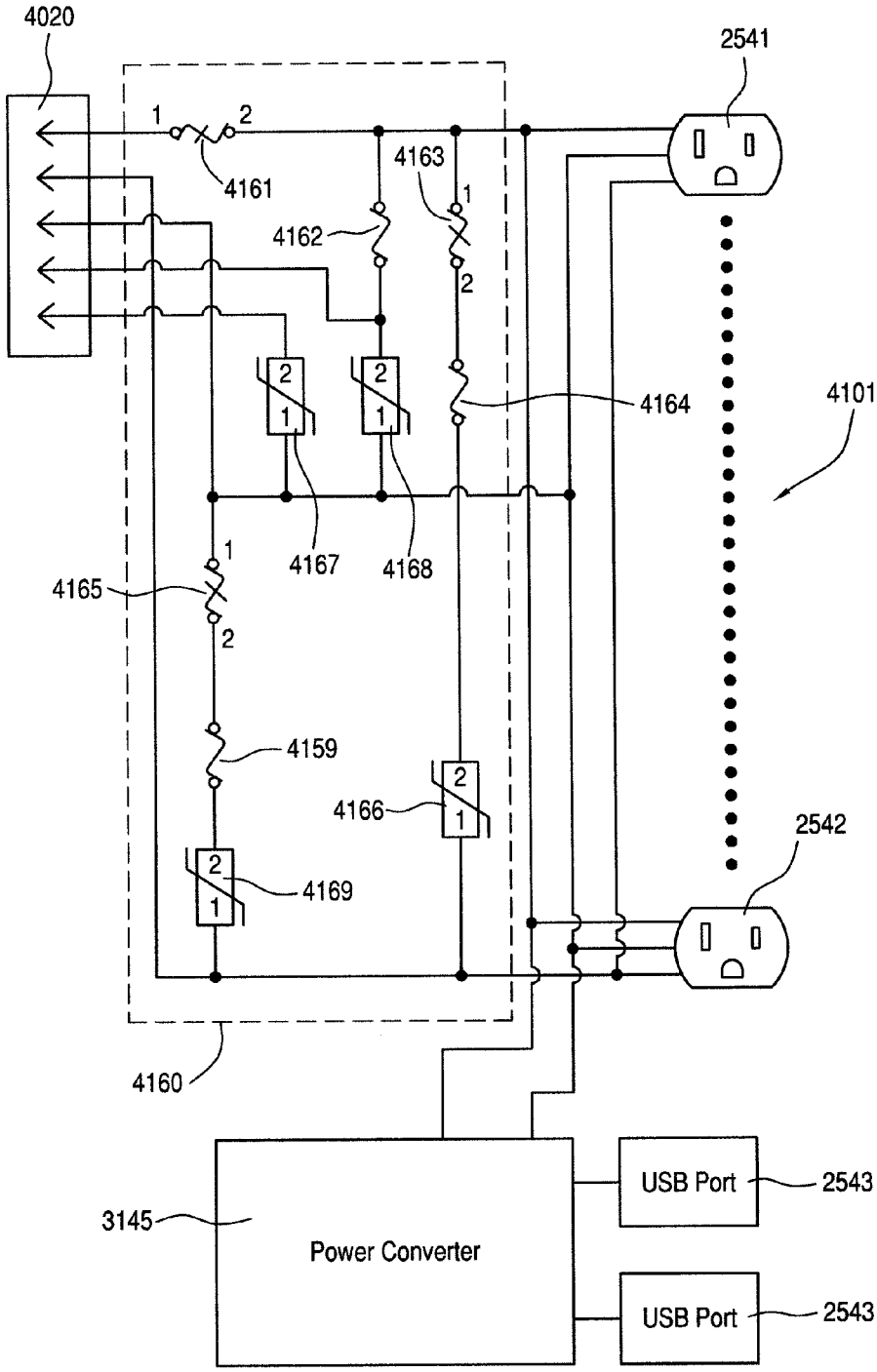
FIG. 41 illustrates a circuit diagram of an exemplary base unit of an exemplary electrical power adapter, according to another embodiment.

FIG. 41 illustrates a circuit diagram of a base unit 4101 of an electrical power adapter 4100, according to another embodiment. Electrical power adapter 4100 is merely exemplary and is not limited to the embodiments presented herein. Electrical power adapter 4100 can be employed in many different embodiments or examples not specifically depicted or described herein.

In some examples, electrical power adapter 4100 can be similar to electrical power adapter 3800 except that electrical power adapter 4100 includes surge protection module 4160 instead of surge protection module 4060.

In some examples, surge protection module 4160 can include: (a) one or more MOVs 4166, 4167, 4168, and 4169; and (b) one or more fuses 4159, 4161, 4162, 4163, 4164, and 4165. MOVs 4166, 4168, and 4169 can be rated at 300 VACrms. MOV 4167 can be rated at 130 VACrms. Fuses 4161, 4163, and 4165 can be thermal cutoff fuses rated at 15 amp (109 degrees Celsius). In various embodiments, a first surge protection module can be considered MOV 4167, and a second surge protection module can be considered MOVs 4166, 4168, and 4169 and fuses 4159, 4161, 4162, 4163, 4164, and 4165. In other examples, other combinations of MOVs, fuses and/or other circuit elements can be used to protect against voltage surges instead of the circuit illustrated in FIG. 41.

When prong adapter 3831 (FIG. 38) is coupled to electrical coupler 4020, wires 3885 and 3886 (FIG. 38) complete the circuit coupling MOV 4167 between the line and the neutral wires. Accordingly, the voltage (i.e., the clamping voltage) at which surge protection module 4160 protects against surge above is lowered from the second surge voltage to the first surge voltage (e.g., from 700 volts to 400 volts) because MOV 4167 is in effect in parallel with MOV 4168.

When prong adapter 3934 (FIG. 39) is coupled to electrical coupler 4020, wires 3885 and 3886 (FIG. 39) do not complete the circuit coupling MOV 4167 between the line and the neutral wires. Accordingly, the voltage (i.e., the clamping voltage) at which surge protection module 4160 protects against surges above is the second higher voltage (e.g., 700 volts).

Figure 42:
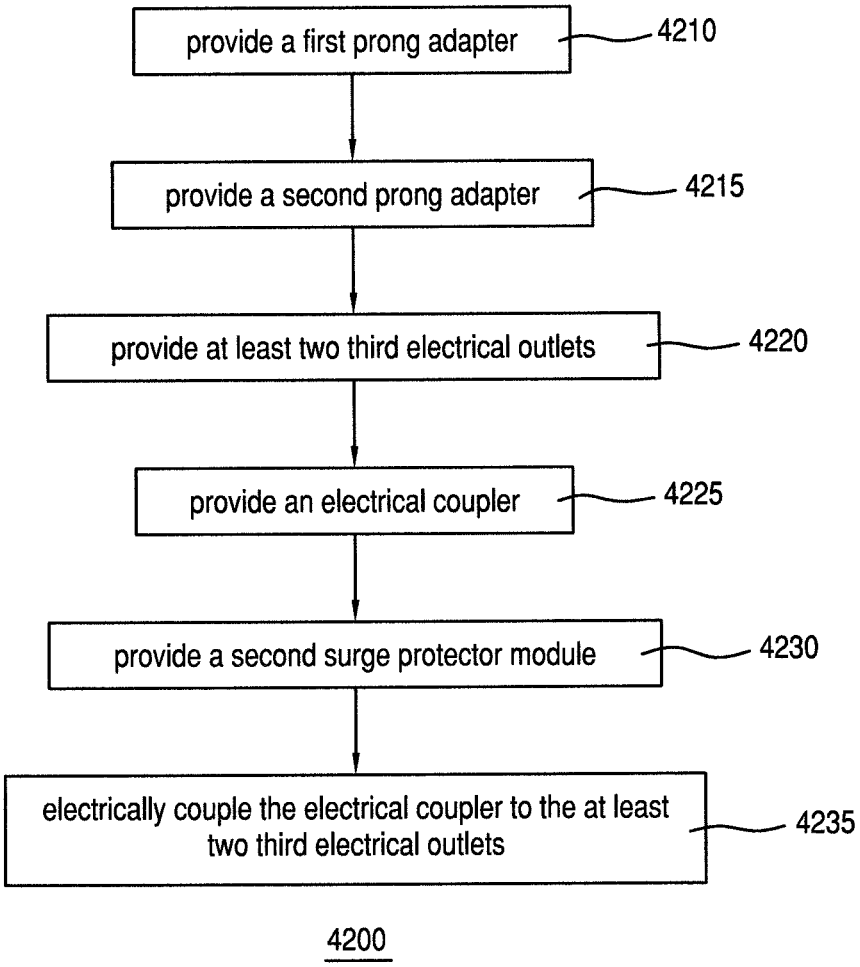
FIG. 42 illustrates a flow chart for an embodiment of an exemplary method of providing an electrical device configured to couple to two or more electrical outlets, according to an embodiment.

FIG. 42 illustrates a flow chart for an embodiment of a method 4200 of providing an electrical device configured to be coupled to two or more electrical outlets, according to an embodiment. Method 4200 is merely exemplary and is not limited to the embodiments presented herein. Method 4200 can be employed in many different embodiments or examples not specifically depicted or described herein. In some embodiments, the activities, the procedures, and/or the processes of method 4200 can be performed in the order presented. In other embodiments, the activities, the procedures, and/or the processes of the method 4200 can be performed in any other suitable order. In still other embodiments, one or more of the activities, the procedures, and/or the processes in method 4200 can be combined or skipped.

Referring to FIG. 42, method 4200 includes an activity 4210 of providing a first prong adapter. In some embodiments, the first prong adapter can be configured to removably couple a first electrical outlet. The first electrical outlet can be configured to provide first electrical power with a first voltage to the first prong adapter when the first prong adapter is coupled to the first electrical outlet. For example, the first prong adapter can be similar or identical to prong adapter 2731 of FIGS. 27 and 29, prong adapter 3331 of FIG. 33, and/or prong adapter 3831 of FIG. 38. Activity 4210 can include providing the first prong adapter to include a United States-style electrical plug.

In various embodiments, activity 4210 can include providing a first prong adapter to include a first surge protection module. For example, the surge protection module can be similar or identical to surge protection module 2970 of FIG. 29.

Method 4200 in FIG. 42 continues with an activity 4215 of providing a second prong adapter. In some embodiments, the second prong adapter can be configured to removably couple a second electrical outlet. The second electrical outlet can be configured to provide second electrical power with a second voltage, where the second voltage of activity 4215 is different than the first voltage of activity 4210. In many embodiments, the second prong adapter is devoid of any surge protection modules.

For example, the second prong adapter can be similar or identical to prong adapter 2732, 2733, and/or 2734 of FIG. 27, prong adapter 3332, 3333, 3334, and/or 3335 of FIG. 33, and/or prong adapter 3934 of FIG. 39. Activity 4215 can include providing the second prong adapter to include a non-United States country-style electrical plug (e.g., a United Kingdom-style, an Australian-style, German-style electrical plug).

Subsequently, method 4200 of FIG. 42 includes an activity 4220 of providing at least two third electrical outlets. In some examples, the at least two third electrical outlets can be similar or identical to electrical outlets 2541 and 2542 of FIG. 25 or electrical outlets 141 and 144 of FIG. 33.

Next, method 4200 of FIG. 42 includes an activity 4225 of providing an electrical coupler. In some examples the electrical coupler can be similar or identical to electrical coupler 2620 of FIG. 26, electrical coupler 3420 of FIG. 34, electrical coupler 3520 of FIG. 35, and/or electrical coupler 4020 of FIG. 40.

Next, method 4200 of FIG. 42 includes an activity 4230 of providing a second surge protection module. In some examples, the second surge protection module can be electrically coupled between the at least two electrical outlets and the electrical coupler. The second surge protector module can be configured to protect against voltage surges above a first surge voltage. The second surge protection module in combination with the first surge protection module can be configured to protect against voltage surges above a second surge voltage. For example, the second surge protection module can be similar or identical to surge protection module 3160 of FIG. 31, surge protection module 3260 of FIG. 32, surge protection module 4060 of FIG. 40, and/or surge protection module 4160 of FIG. 41.

Method 4200 in FIG. 42 continues with an activity 4235 of electrically coupling the electrical coupler to the at least two electrical outlets. In some examples, the electrical coupler can be coupled to the at least two third electrical outlets such that when the first prong adapter is coupled to the electrical coupler and the first electrical outlet, the at least two third electrical outlets receive the first electrical power with the first voltage and that when the second prong adapter is coupled to the electrical coupler and the second electrical outlet, the at least two third electrical outlets receive the second electrical power with the second voltage.

Although the invention has been described with reference to specific embodiments, it will be understood by those skilled in the art that various changes may be made without departing from the spirit or scope of the invention. For example, to one of ordinary skill in the art, it will be readily apparent that the electrical connector can comprise an electrical plug or prong adapter that conforms to European or other country standards, instead of a plug that conforms to United States or Australian standards. In the same or a different example, the electrical connector (and not only the prong adapter) can comprise a two-prong plug, instead of a three-prong plug. In at least some embodiments, the housing can be referred to as a case, the rotation coupler can be referred to as a coupling section, the lock can be referred to as a tab; the lock receivers can be referred to as lock notches, the lock de-actuator can be referred to as a lock switch, the prong adapter can be referred to as a revolver platform, and/or the predetermined orientations can be referred to as standard orientations. Additional examples have been given in the foregoing description. Accordingly, the disclosure of embodiments of the invention is intended to be illustrative of the scope of the invention and is not intended to be limiting. It is intended that the scope of the invention shall be limited only to the extent required by the appended claims.

For example, to one of ordinary skill in the art, it will be readily apparent that the electrical connector and method discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An apparatus configured to provide electrical power received from at least a first electrical outlet and a second electrical outlet, the first electrical outlet configured to provide first electrical power with a first voltage, the second electrical outlet configured to provide second electrical power with a second voltage different than the first voltage, the apparatus comprising:

a housing;

at least two third electrical outlets at the housing;

an electrical coupler at least partially enclosed by the housing and electrically coupled to the at least two third electrical outlets;

a first prong adapter configured to removably couple to the electrical coupler and the first electrical outlet;

a second prong adapter configured to removably couple to the electrical coupler and the second electrical outlet;

a first surge protector circuit electrically coupled between the electrical coupler and the at least two third electrical outlets; and a second surge protector circuit, wherein:

the first prong adapter is configured to receive the first electrical power with the first voltage from the first electrical outlet when the first prong adapter is coupled to the first electrical outlet;

the second prong adapter is configured to receive the second electrical power with the second voltage from the second electrical outlet when the second prong adapter is coupled to the second electrical outlet;

the electrical coupler is electrically coupled to the at least two third electrical outlets such that when the first prong adapter is coupled to the electrical coupler and the first electrical outlet, the at least two third electrical outlets receive the first electrical power with the first voltage;

the electrical coupler is further electrically coupled to the at least two third electrical outlets such that when the second prong adapter is coupled to the electrical coupler and the second electrical outlet, the at least two third electrical outlets receive the second electrical power with the second voltage;

the first surge protector circuit is configured to protect against voltage surges above a first surge voltage;

the second surge protector circuit in combination with the first surge protector circuit is configured to protect against voltage surges above a second surge voltage; and the second surge voltage is less than the first surge voltage.

2. An electrical power adapter comprising:

a housing with an interior cavity;

two or more electrical outlets accessible through the housing;

a first surge protection module at least partially located in the interior cavity of the housing and electrically coupled to the two or more electrical outlets;

an electrical attachment mechanism at the housing and electrically coupled to the first surge protection module; and two or more prong devices configured to removably couple to the electrical attachment mechanism, wherein:

at least a first one of the two or more prong devices comprise at least part of a second surge protection module;

each of the two or more prong devices comprises an electrical plug;

the electrical plug of each of the two or more prong devices are configured to couple to a different country-style electrical outlet the first surge protection module is configured to protect against voltage spikes above a first spike voltage;

the second surge protection module in combination with the first surge protection module is configured to protect against voltage spikes above a second spike voltage; and the second spike voltage is less than the first spike voltage.

3. A method of providing an electrical device configured to couple to a first electrical outlet and a second electrical outlet, the first electrical outlet configured to provide first electrical power with a first voltage, the second electrical outlet configured to provide second electrical power with a second voltage, the method comprising:

providing a first prong adapter configured to removably couple to the first electrical outlet;

providing a second prong adapter configured to removably couple to the second electrical outlet;

providing at least two third electrical outlets;

providing an electrical coupler configured to removably couple to the first prong adapter and the second prong adapter;

providing a first surge protection module electrically coupled between the electrical coupler and the at least two third electrical outlets and is configured to protect against voltage surges above a first surge voltage; and electrically coupling the electrical coupler to the at least two third electrical outlets such that when the first prong adapter is coupled to the electrical coupler and the first electrical outlet, the at least two third electrical outlets receive the first electrical power with the first voltage, and that when the second prong adapter is coupled to the electrical coupler and the second electrical outlet, the at least two third electrical outlets receive the second electrical power with the second voltage wherein:

providing the first prong adapter comprises:

providing the first prong adapter comprising at least part of a second surge protection module, the second surge protection module in combination with the first surge protection module is configured to protect against voltage surges above a second surge voltage; and the second surge voltage is lower than the first surge voltage.

4. The apparatus of claim 1, wherein:

the second surge protector circuit is located in the first prong adapter.

5. The apparatus of claim 1, wherein:

a first part of the second surge protector circuit is located in the first prong adapter; and a second part of the second surge protector circuit is located in the housing.

6. The apparatus of claim 1, wherein:

the first surge voltage is approximately 700 volts; and the second surge voltage is approximately 400 volts.

7. The apparatus of claim 1, wherein:

the second surge protector circuit comprises:

one or more metal oxide varistors; and one or more fuses.

8. The apparatus of claim 1, wherein:

the second prong adapter is devoid of any surge protector circuits.

9. The apparatus of claim 1, wherein:

the first surge protector circuit comprises:

one or more metal oxide varistors; and one or more fuses.

10. The apparatus of claim 1, further comprising:

a third prong adapter configured to removably couple to the electrical coupler and a fourth electrical outlet, wherein:

the third prong adapter is configured to receive a third electrical power with a third voltage from the fourth electrical outlet when the third prong adapter is coupled to the fourth electrical outlet; and the electrical coupler is further electrically coupled to the at least two third electrical outlets such that when the third prong adapter is coupled to the electrical coupler and the third prong adapter is further coupled to the fourth electrical outlet, the at least two third electrical outlets receive the third electrical power with the third voltage.

11. The apparatus of claim 1, wherein:

the first prong adapter is configured to provide 120 volt alternating current to the electrical coupler;

the first electrical outlet is configured to provide the 120 volt alternating current when the first prong adapter is coupled to the electrical coupler;

the second prong adapter is configured to provide 230 volt alternating current to the electrical coupler; and the second electrical outlet is configured to provide the 120 volt alternating current when the second prong adapter is coupled to the electrical coupler.

12. The apparatus of claim 1, wherein:

the at least two third electrical outlets comprise United States-style electrical outlets;

the first prong adapter comprises a United States-style electrical plug; and the second prong adapter comprises a United Kingdom-style electrical outlet.

13. The apparatus of claim 1, further comprising:

one or more electrical connectors; and a power converter electrically coupled to the electrical coupler and configured to provide a substantially constant direct current to the one or more electrical connectors.

14. The apparatus of claim 1, wherein:

the electrical coupler comprises a rotation coupler;

the first prong adapter is rotatable 360 degrees relative to the housing when the first prong adapter is coupled to the electrical coupler; and the second prong adapter is rotatable 360 degrees relative to the housing when the second prong adapter is coupled to the electrical coupler.

15. The apparatus of claim 1, wherein:
the electrical coupler is rotatable relative to the housing.

16. The method of claim 3, wherein:
providing the first prong adapter comprises:
providing the first prong adapter such that the first prong adapter is configured to provide 120 volt alternating current to the electrical coupler;
providing the second prong adapter comprises:
providing the second prong adapter such that the second prong adapter is configured to provide 230 volt alternating current to the electrical coupler.

17. The electrical power adapter of claim 2, wherein:
each of the two or more electrical outlets comprise United States-style electrical outlets; and
a first electrical plug of the two or more prong devices comprises a United States-style plug.

18. The electrical power adapter of claim 17, wherein:
a second electrical plug of the two or more prong devices comprises a second country-style plug; and
the second country-style plug is different from the United States-style plug.

19. The electrical power adapter of claim 2, wherein:
at least a second one of the two or more prong devices is devoid of any surge protection modules.

20. The electrical power adapter of claim 2, wherein:
the electrical attachment mechanism comprises a rotation coupler;
a first one of the two or more prong devices is rotatable 360 degrees relative to the housing when the first one of the two or more prong devices is coupled to the electrical attachment mechanism; and
a second one of the two or more prong devices is rotatable 360 degrees relative to the housing when the second one of the two or more prong devices is coupled to the electrical attachment mechanism.

21. The electrical power adapter of claim 2, wherein:
the at least the first one of the two or more prong devices is configured to provide 120 volt alternating current to the electrical attachment mechanism;
the two or more electrical outlets are configured to provide the 120 volt alternating current when the at least a first one of the two or more prong devices is coupled to the electrical attachment mechanism;
at least a second one of the two or more prong devices is configured to provide 230 volt alternating current to the electrical attachment mechanism; and
the two or more electrical outlets are configured to provide the 120 volt alternating current when the at least the second one of the two or more prong devices is coupled to the electrical attachment mechanism.

22. The method of claim 3, wherein:
the first surge protection module is configured to protect against 700 volt and higher surges, but not protect against 450 volt surges; and
the second surge protection module is configured to protect against 400 volt and higher surges.

23. The method of claim 3, further comprising:
providing a third prong adapter configured to removably couple to a third electrical outlet,
wherein:
electrically coupling the electrical coupler comprises:
electrically coupling the electrical coupler to the at least two third electrical outlets such that when the third prong adapter is coupled to the electrical coupler and the third electrical outlet, the at least two third electrical outlets receive a third electrical power with a third voltage.

24. The method of claim 3, wherein:
providing the second prong adapter comprises:
providing the second prong adapter devoid of any surge protection modules.

25. The method of claim 3, wherein:
providing the first prong adapter comprises:
providing the first prong adapter comprising a United States-style plug; and
providing the second prong adapter comprises:
providing the second prong adapter comprising a second country-style plug; and
the second country-style plug is different than the United States-style plug.

* * * * *